US007158108B2

(12) United States Patent
Hagino

(10) Patent No.: US 7,158,108 B2
(45) Date of Patent: Jan. 2, 2007

(54) COLUMN ELECTRODE DRIVING CIRCUIT AND VOLTAGE GENERATING CIRCUIT FOR A LIQUID CRYSTAL DISPLAY

(75) Inventor: Shuji Hagino, Kobe (JP)

(73) Assignee: Koninklijke Philips Electronics, N.V., Eindhoven (NL)

( * ) Notice: Subject to any disclaimer, the term of this patent is extended or adjusted under 35 U.S.C. 154(b) by 255 days.

(21) Appl. No.: 10/496,552

(22) PCT Filed: Nov. 29, 2002

(86) PCT No.: PCT/IB02/05051

§ 371 (c)(1),
(2), (4) Date: May 25, 2004

(87) PCT Pub. No.: WO03/046880

PCT Pub. Date: Jun. 5, 2003

(65) Prior Publication Data

US 2005/0078077 A1 Apr. 14, 2005

(30) Foreign Application Priority Data

Nov. 30, 2001 (JP) ..... 2001-366231
Apr. 8, 2002 (JP) ..... 2002-105744

(51) Int. Cl.
*G09G 3/36* (2006.01)
*G09G 5/10* (2006.01)

(52) U.S. Cl. ..... 345/89; 345/98; 345/690

(58) Field of Classification Search ..... 345/87–100, 345/211, 690
See application file for complete search history.

(56) References Cited

U.S. PATENT DOCUMENTS

| | | | | |
|---|---|---|---|---|
| 5,874,933 | A * | 2/1999 | Hirai et al. | 345/89 |
| 6,756,959 | B1 * | 6/2004 | Fujino | 345/95 |
| 6,806,860 | B1 * | 10/2004 | Saito et al. | 345/98 |
| 2002/0008686 | A1 * | 1/2002 | Kumada et al. | 345/94 |
| 2002/0036624 | A1 * | 3/2002 | Ohta et al. | 345/204 |

* cited by examiner

*Primary Examiner*—Bipin Shalwala
*Assistant Examiner*—David L. Lewis

(57) ABSTRACT

Column electrode driving circuit for a display device which reduces power consumption arid is capable of gray-scale displaying. The driving circuit include a gray-scale voltage producing system including amplifiers whose inputs are applied with a plurality of gray-scale voltages, respectively, and a selecting system for selecting and outputting any of output signals of the amplifiers for each pixel or each predetermined displayed unit in accordance with an image signal indicative of a gray-scale level for the pixel or displayed unit. The gray-scale voltage producing system causes any amplifiers of the amplifiers, which correspond to a predetermined number of predetermined gray scale levels, to be powered off and causing the other amplifiers to be powered on during a predetermined mode, the selecting system select any of output signals of the amplifiers powered on during the predetermined mode. A further construction based on potential divider circuits is also disclosed.

19 Claims, 27 Drawing Sheets

| | MSB | | | | | LSB | |
|---|---|---|---|---|---|---|---|
| $D_n$: | $Q_5$ | $Q_4$ | $Q_3$ | $Q_2$ | $Q_1$ | $Q_0$ | |
| | 0 | 0 | 0 | 0 | 0 | 0 | #0 |
| | 0 | 0 | 0 | 0 | 0 | 1 | #1 |
| | 0 | 0 | 0 | 0 | 1 | 0 | #2 |
| | 0 | 0 | 0 | 0 | 1 | 1 | #3 |
| | | | | • | | | • |
| | | | | • | | | • |
| | | | | • | | | • |
| | 1 | 1 | 1 | 1 | 0 | 1 | #61 |
| | 1 | 1 | 1 | 1 | 1 | 0 | #62 |
| | 1 | 1 | 1 | 1 | 1 | 1 | #63 |

FIG.5

4-bit Displaying

| | | | | | | |
|---|---|---|---|---|---|---|
| 0 | 0 | 0 | 0 | 0 | 0 | #0 |
| 0 | 0 | 0 | 1 | 0 | 0 | #4 |
| 0 | 0 | 1 | 0 | 0 | 0 | #8 |
| 0 | 0 | 1 | 1 | 0 | 0 | #12 |
| 0 | 1 | 0 | 0 | 0 | 1 | #17 |
| 0 | 1 | 0 | 1 | 0 | 1 | #21 |
| 0 | 1 | 1 | 0 | 0 | 1 | #25 |
| 0 | 1 | 1 | 1 | 0 | 1 | #29 |
| 1 | 0 | 0 | 0 | 1 | 0 | #34 |
| 1 | 0 | 0 | 1 | 1 | 0 | #38 |
| 1 | 0 | 1 | 0 | 1 | 0 | #42 |
| 1 | 0 | 1 | 1 | 1 | 0 | #46 |
| 1 | 1 | 0 | 0 | 1 | 1 | #51 |
| 1 | 1 | 0 | 1 | 1 | 1 | #55 |
| 1 | 1 | 1 | 0 | 1 | 1 | #59 |
| 1 | 1 | 1 | 1 | 1 | 1 | #63 |

| | | | | | | |
|---|---|---|---|---|---|---|
| 0 | 0 | 0 | 0 | 0 | 0 | #0 |
| 0 | 0 | 0 | 1 | 0 | 0 | #4 |
| 0 | 0 | 1 | 0 | 0 | 0 | #8 |
| 0 | 0 | 1 | 1 | 0 | 0 | #12 |
| 0 | 1 | 0 | 0 | 0 | 1 | #17 |
| 0 | 1 | 0 | 1 | 0 | 1 | #21 |
| 0 | 1 | 1 | 0 | 0 | 1 | #25 |
| 0 | 1 | 1 | 1 | 0 | 1 | #29 |
| 1 | 0 | 0 | 0 | 1 | 0 | #34 |
| 1 | 0 | 0 | 1 | 1 | 0 | #38 |
| 1 | 0 | 1 | 0 | 1 | 0 | #42 |
| 1 | 0 | 1 | 1 | 1 | 0 | #46 |
| 1 | 1 | 0 | 0 | 1 | 1 | #51 |
| 1 | 1 | 0 | 1 | 1 | 1 | #55 |
| 1 | 1 | 1 | 0 | 1 | 1 | #59 |
| 1 | 1 | 1 | 1 | 1 | 1 | #63 |

| | | | | | | |
|---|---|---|---|---|---|---|
| 0 | 0 | 0 | 0 | 1 | 1 | #3 |
| 0 | 0 | 0 | 1 | 1 | 1 | #7 |
| 0 | 0 | 1 | 0 | 1 | 1 | #11 |
| 0 | 0 | 1 | 1 | 1 | 1 | #15 |
| 0 | 1 | 0 | 0 | 1 | 1 | #19 |
| 0 | 1 | 0 | 1 | 1 | 1 | #23 |
| 0 | 1 | 1 | 0 | 1 | 1 | #27 |
| 0 | 1 | 1 | 1 | 1 | 1 | #31 |
| 1 | 0 | 0 | 0 | 1 | 1 | #35 |
| 1 | 0 | 0 | 1 | 1 | 1 | #39 |
| 1 | 0 | 1 | 0 | 1 | 1 | #43 |
| 1 | 0 | 1 | 1 | 1 | 1 | #47 |
| 1 | 1 | 0 | 0 | 1 | 1 | #51 |
| 1 | 1 | 0 | 1 | 1 | 1 | #55 |
| 1 | 1 | 1 | 0 | 1 | 1 | #59 |
| 1 | 1 | 1 | 1 | 1 | 1 | #63 |

| | | | | | | |
|---|---|---|---|---|---|---|
| 0 | 0 | 0 | 0 | 1 | 1 | #3 |
| 0 | 0 | 0 | 1 | 1 | 1 | #7 |
| 0 | 0 | 1 | 0 | 1 | 1 | #11 |
| 0 | 0 | 1 | 1 | 1 | 1 | #15 |
| 0 | 1 | 0 | 0 | 1 | 1 | #19 |
| 0 | 1 | 0 | 1 | 1 | 1 | #23 |
| 0 | 1 | 1 | 0 | 1 | 1 | #27 |
| 0 | 1 | 1 | 1 | 1 | 1 | #31 |
| 1 | 0 | 0 | 0 | 1 | 1 | #35 |
| 1 | 0 | 0 | 1 | 1 | 1 | #39 |
| 1 | 0 | 1 | 0 | 1 | 1 | #43 |
| 1 | 0 | 1 | 1 | 1 | 1 | #47 |
| 1 | 1 | 0 | 0 | 1 | 1 | #51 |
| 1 | 1 | 0 | 1 | 1 | 1 | #55 |
| 1 | 1 | 1 | 0 | 1 | 1 | #59 |
| 1 | 1 | 1 | 1 | 1 | 1 | #63 |

| | | | | | | |
|---|---|---|---|---|---|---|
| 0 | 0 | 0 | 0 | 0 | 0 | #0 |
| 0 | 0 | 0 | 1 | 0 | 0 | #4 |
| 0 | 0 | 1 | 0 | 0 | 0 | #8 |
| 0 | 0 | 1 | 1 | 0 | 0 | #12 |
| 0 | 1 | 0 | 0 | 0 | 0 | #16 |
| 0 | 1 | 0 | 1 | 0 | 0 | #20 |
| 0 | 1 | 1 | 0 | 0 | 0 | #24 |
| 0 | 1 | 1 | 1 | 0 | 0 | #28 |
| 1 | 0 | 0 | 0 | 0 | 0 | #32 |
| 1 | 0 | 0 | 1 | 0 | 0 | #36 |
| 1 | 0 | 1 | 0 | 0 | 0 | #40 |
| 1 | 0 | 1 | 1 | 0 | 0 | #44 |
| 1 | 1 | 0 | 0 | 0 | 0 | #48 |
| 1 | 1 | 0 | 1 | 0 | 0 | #52 |
| 1 | 1 | 1 | 0 | 0 | 0 | #56 |
| 1 | 1 | 1 | 1 | 0 | 0 | #60 |

| | | | | | | |
|---|---|---|---|---|---|---|
| 0 | 0 | 0 | 0 | 0 | 0 | #0 |
| 0 | 0 | 0 | 1 | 0 | 0 | #4 |
| 0 | 0 | 1 | 0 | 0 | 0 | #8 |
| 0 | 0 | 1 | 1 | 0 | 0 | #12 |
| 0 | 1 | 0 | 0 | 0 | 0 | #16 |
| 0 | 1 | 0 | 1 | 0 | 0 | #20 |
| 0 | 1 | 1 | 0 | 0 | 0 | #24 |
| 0 | 1 | 1 | 1 | 0 | 0 | #28 |
| 1 | 0 | 0 | 0 | 0 | 0 | #32 |
| 1 | 0 | 0 | 1 | 0 | 0 | #36 |
| 1 | 0 | 1 | 0 | 0 | 0 | #40 |
| 1 | 0 | 1 | 1 | 0 | 0 | #44 |
| 1 | 1 | 0 | 0 | 0 | 0 | #48 |
| 1 | 1 | 0 | 1 | 0 | 0 | #52 |
| 1 | 1 | 1 | 0 | 0 | 0 | #56 |
| 1 | 1 | 1 | 1 | 0 | 0 | #60 |

| | | | | | | |
|---|---|---|---|---|---|---|
| 0 | 0 | 0 | 0 | 0 | 0 | #0 |
| 0 | 0 | 1 | 0 | 0 | 1 | #9 |
| 0 | 1 | 0 | 0 | 1 | 0 | #18 |
| 0 | 1 | 1 | 0 | 1 | 1 | #27 |
| 1 | 0 | 0 | 1 | 0 | 0 | #36 |
| 1 | 0 | 1 | 1 | 0 | 1 | #45 |
| 1 | 1 | 0 | 1 | 1 | 0 | #54 |
| 1 | 1 | 1 | 1 | 1 | 1 | #63 |

| | | | | | | |
|---|---|---|---|---|---|---|
| 0 | 0 | 0 | 0 | 0 | 0 | #0 |
| 0 | 1 | 0 | 1 | 0 | 1 | #21 |
| 1 | 0 | 1 | 0 | 1 | 0 | #42 |
| 1 | 1 | 1 | 1 | 1 | 1 | #63 |

| Mode \ Control Singal | | $C_6$ | $C_4$ | $C_3$ | $C_1$ | $C_x$ | Number of Presented Gray-scale Levels |
|---|---|---|---|---|---|---|---|
| Normal | 6-bit Displaying | H | L | L | L | L | 64 |
| | 4-bit Displaying | L | H | L | L | L | 16 |
| | 3-bit Displaying | L | L | H | L | L | 8 |
| | 1-bit Displaying | L | L | L | H | L | 2 |
| Forced | | X | X | X | X | H | 2 |

FIG.24

COLUMN ELECTRODE DRIVING CIRCUIT AND VOLTAGE GENERATING CIRCUIT FOR A LIQUID CRYSTAL DISPLAY

BACKGROUND OF THE INVENTION

1. Field of the Invention

The present invention relates to a display device, and in particular to a column electrode driving circuit used for a display device that can perform multi-gray-scale displaying or multicolored displaying.

2. Description of the Related Art

In a liquid crystal display device, for example, many pixels (pixel areas) are provided over an entire display area in a matrix or in an array equivalent thereto, and row and column electrodes are provided for applying parts of a liquid crystal medium corresponding to these pixels with the respective electric fields according to the pixel information. The row electrodes are electrically conductive patterns that extend in a horizontal direction in the display area and the column electrodes are electrically conductive patterns that extend in a vertical direction in the same area.

Most active matrix type liquid crystal display devices are provided with, for example, TFTs (thin film transistors) as active elements to individually drive parts of the liquid crystal medium for each pixel, wherein the row electrodes are connected to the gates of the TFTs and the column electrodes are connected to the sources of the TFTs. Usually, one of the row electrodes corresponding to so-called scanning lines is selected for each horizontal scanning period of an image signal, and a gate voltage is supplied to the selected row electrode for simultaneously activating a group of TFTs connected to the selected row electrode. On the other hand, source voltages (pixel information signals) according to an image of the line are supplied to the activated TFTs to display the image of the line. Driving circuits for performing voltage-application to the row and column electrodes are provided, respectively.

There is one typical type of column electrode driving circuit which generates a number of gray-scale voltages necessary for different gray-scale levels required for the display device, and selects any of the gray-scale voltages in accordance with the pixel information for each pixel information signal so as to supply the selected gray-scale voltage to the corresponding column electrode. This driving circuit is arranged in such a manner that all gray-scale voltages are outputted via amplifiers. There is also a type of column electrode driving circuit that has amplifiers whose outputs are connected to the column electrodes, respectively.

The present inventor has noticed that the former would cause the amplifiers and their peripheral circuits to have an enormous power consumption. The present inventor has also conceived that the latter would have a feature of constantly operating quite a large number of amplifiers corresponding in number to dots for one line of the displayed image and again having an enormous power consumption, whereby it can be estimated that power consumption will increase further considering an increase in the number of dots based on a tendency to increase resolution in the future.

With the advent of portable devices or wearable devices such as cellular phones whose display functions have been unprecedentedly enhanced, there is a perception that notably the latest electronics devices are required not only to allow a long time operation with a limited battery capacity but also to have high-level display performance.

SUMMARY OF THE INVENTION

It is an object of the present invention to provide a column electrode driving circuit with a reduced power consumption. The invention is defined by the independent claims. The dependent claims define advantageous embodiments.

It is possible to switch off amplifiers that are to output gray-scale voltages for gray-scale levels that are not displayed during the predetermined mode. This reduces the power consumption of the driving circuit and enables a longer operating time of a portable battery operated device using the driving circuit. Such a driving circuit can also support a forced mode, so that aggressive power saving can be accomplished. Furthermore, the selecting means perform a selection operation in accordance with the non-operating amplifiers and still operating amplifiers, and can thereby select an appropriate gray-scale voltage. The "display segment" referred to here is intended to mean that the present invention can also cover driving circuits for display devices wherein a segment comprising a plurality of pixels, is driven by one signal.

The predetermined mode may include a plurality of sub-modes, and the amplifiers to be powered on may be determined for each sub-mode in the gray-scale voltage producing means. This embodiment is adapted to the case where there is a plurality of kinds of gray-scale levels to be displayed and allows fine control for power saving. Furthermore, the driving circuit may comprise means for receiving a control signal for designating a content of the predetermined mode, and the gray-scale voltage producing means may perform power control on the power supply of the amplifiers in accordance with the control signal.

Specific gray-scale voltage values applied to amplifiers to be powered on may be assigned gray-scale voltage values within the range of voltage values between a minimum gray-scale voltage value to a maximum gray-scale voltage value, which have been selected in accordance with the predetermined mode. It is preferable here that the specific gray-scale voltages may include a maximum gray-scale voltage and/or a minimum gray-scale voltage. Accordingly, even if the display mode is changed to a mode of a smaller number of gray-scale levels, this makes it possible to effectively use the available gray-scale voltage range. Especially when both the maximum gray-scale voltage and minimum gray-scale voltage are adopted as specific gray-scale voltages, it is possible to use the full range and minimize deterioration of the display quality during the mode of displaying a smaller number of gray-scale levels.

Selecting either one may be structurally advantageous. Although the specific gray-scale voltages may be assigned gray-scale voltage values which are gradually ranked in substantially equal intervals within the voltage range, the specific gray-scale voltages may also be ranked intentionally in unequal intervals in a certain form, e.g. having correction characteristics.

On the other hand, the driving circuit may further comprise data processing means for converting an input bit train comprising a sequence of groups of bits, each group of bits determining a gray level of an image point of the image, for each display segment a corresponding image point being present, of an input image signal into a new bit train having only groups of bits corresponding to the predetermined gray-scale values designated by the predetermined mode;

the selecting means performing selection based on the image signals being the new bit train. Adopting such data processing and the corresponding configuration makes it possible to appropriately select effective outputs of the gray-scale voltage producing means without changing the selecting manner of the selecting means even if the number of image signal data bits changes in accordance with the number of the gray-scale levels to be represented. In the case where a forced mode which will be described later is specified, even if the number of data bits of an image signal does not correspond with this case, an appropriate selection can be made likewise.

Here, the data processing means may form the bit train of the prescribed number of bits using a content of at least one higher-order bit of a bit train of an input image signal for its lower-order bit, or the data processing means form the bit train of the prescribed number of bits using a fixed value of at least one bit for its lower-order bit. More preferably, the data processing means may form the bit train of the prescribed number of bits such that the bit train can have a value capable of designating a maximum gray-scale voltage and/or a minimum gray-scale voltage. This allows the prescribed gray-scale voltage range to be used effectively.

Furthermore, in order to attain the above objects, a driving circuit according to a second aspect of the present invention is a column electrode driving circuit for a display device capable of gray-scale displaying, comprising: gray-scale voltage producing means including amplifiers which relay a plurality of gray-scale voltages having values that are gradually level-shifted, respectively, and potential divider circuits coupled with outputs of the amplifiers for dividing their output voltages to produce diminished gray-scale voltages; and selecting means for selecting and outputting any of the gray-scale voltages for each pixel or each predetermined displayed unit in accordance with an image signal indicative of a gray-scale level for the pixel or displayed unit, the gray-scale voltage producing means output-disabling any potential divider circuits that produce a predetermined number of gray-scale voltages which correspond to predetermined gray-scale levels, in a predetermined mode, by electrically isolating the subject potential divider circuit from the corresponding amplifier or by avoiding an output current of that amplifier from flowing possibly caused by its dividing action to make the flowing to be substantially impossible, the selecting means selecting any of effective voltages during the predetermined mode. This aspect can also reduce power consumption of the potential divider circuits for outputting gray-scale voltages for gray-scale levels unnecessary for displaying in the predetermined mode.

The divider circuits may have a first connection end given a higher potential and a second connection end given a lower potential for dividing a potential difference between the first and second connection ends, the connection ends being coupled between output lines of the amplifiers, at least one of the connection ends being coupled to the output line via a switching circuit that causes a conducting path between the output lines to be opened or closed, the switching circuit performing open-control on the path at the time when output of the divider circuit is disabled. In the case where the gray-scale voltage producing means disables an output current supply of the amplifier from flowing caused by its potential dividing effect, the divider circuits may have a first connection end given a higher potential and a second connection end given a lower potential for dividing a potential difference between the first and second connection ends, the connection ends being coupled between output lines of the amplifiers, only one of the connection ends being coupled to the output line via a switching circuit that causes a conducting path between the output lines to be opened or closed, the switching circuit performing open-control on the path at the time when output of the divider circuit is disabled. This allows desired gray-scale voltages to be outputted appropriately without changing the selecting manner of the selecting means during a forced mode or a display mode making the same gray-scale representation as in the forced mode. That is, when output of the divider circuit is disabled, the divider output end has substantially the same potential as the higher potential or lower potential applied to the one connection end which remains connected to the amplifier output of the divider circuit, and therefore even if the level represented at the divider output end is selected by the selecting means, a specific (not divided) gray-scale voltage corresponding to a potential of the one connection end will be selected. This makes it possible to easily implement the forced mode and modes equivalent thereto.

As in the case of the above-described features, this aspect can also additionally have such features:

- the predetermined mode includes a plurality of sub-modes, and the potential divider circuits to be output-enabled are determined for each sub-mode in the gray-scale voltage producing means;
- the driving circuit comprises means for receiving a control signal for designating a content of the predetermined mode, and the gray-scale voltage producing means perform output-disablement/enablement control on the potential divider circuits in accordance with the control signal;
- specific gray-scale voltages to be output-enabled are assigned gray-scale voltage values within a voltage range from a maximum gray-scale voltage value to a minimum gray-scale voltage value, which have been picked out in accordance with the predetermined mode;
- the specific gray-scale voltages include a maximum gray-scale voltage and/or a minimum gray-scale voltage.
- the specific gray-scale voltages are assigned gray-scale voltage values which are gradually ranked in substantially equal intervals within the voltage range;
- the driving circuit further comprises data processing means for performing a data process of forming, on the basis of a bit train of an input image signal, a bit train having a prescribed number of bits capable of representing gray-scale levels to be represented in the predetermined mode, the gray-scale levels being designated by the predetermined mode; the selecting means decide a selecting state in accordance with an input data based on a new bit train obtained by the data processing means; and the gray-scale voltage producing means are arranged to designate, as the gray-scale voltages to be output-enabled outputted, gray-scale voltages corresponding to gray-scale levels that can be designated by the new bit train in the predetermined mode;
- the data processing means form the bit train of the prescribed number of bits using a content of at least one higher-order bit of a bit train of an input image signal for its lower-order bit;
- the data processing means form the bit train of the prescribed number of bits using a fixed value of at least one bit for its lower-order bit; and
- the data processing means form the bit train of the prescribed number of bits such that the bit train can have a value capable of designating a maximum gray-scale voltage and/or a minimum gray-scale voltage.

Accordingly, it is possible to expect advantages peculiar to these features.

In the above-described first and second aspects, the predetermined mode may have at least one mode to represent a less number of gray-scale levels than the maximum number of gray-scale levels, or the predetermined mode may include a mode to represent a necessary number of gray-scale levels for display operation and a mode to represent gray-scale levels forcedly designated. And outputs of the gray-scale voltage producing means may be applied to the selecting means not via other amplifiers, and the selecting means may make their selection outputs not via other amplifiers, which can further promote the power reduction effect.

The present invention also provides a display device using the above-described driving circuit. When the display device to which the present invention is applied is a device such as a cellular phone, the contents of the predetermined mode or the number of gray-scale levels to be displayed may be determined in accordance with whether or not it is in a mode of e.g. waiting for a communication operation, not in a main operating mode such as a telephone conversation or in accordance with a status of the waiting mode. In the waiting mode, the user usually does not attach much importance to the display performance of the display device. Therefore, in such a mode, reducing the number of gray-scale levels to be displayed does not mean substantially reducing the display performance. So, in cooperation with such condition, reducing power consumption of the driving circuit as mentioned above would be extremely convenient.

BRIEF DESCRIPTION OF THE DRAWINGS

These and other aspects of the invention will be further elucidated and described with reference to the drawings, in which:

FIG. 5 is a schematic illustration showing an arrangement of a pixel data block in an image data signal and relations between values of the block and the corresponding gray-scale voltages;

FIG. 24 is a table showing defined contents of control signals used in the gray-scale voltage producing circuit of FIGS. 22 and 23;

DESCRIPTION OF THE PREFERRED EMBODIMENT(S)

The embodiments of the present invention will be hereinbelow explained in more detail with reference to the accompanying drawings.

Figure 1:
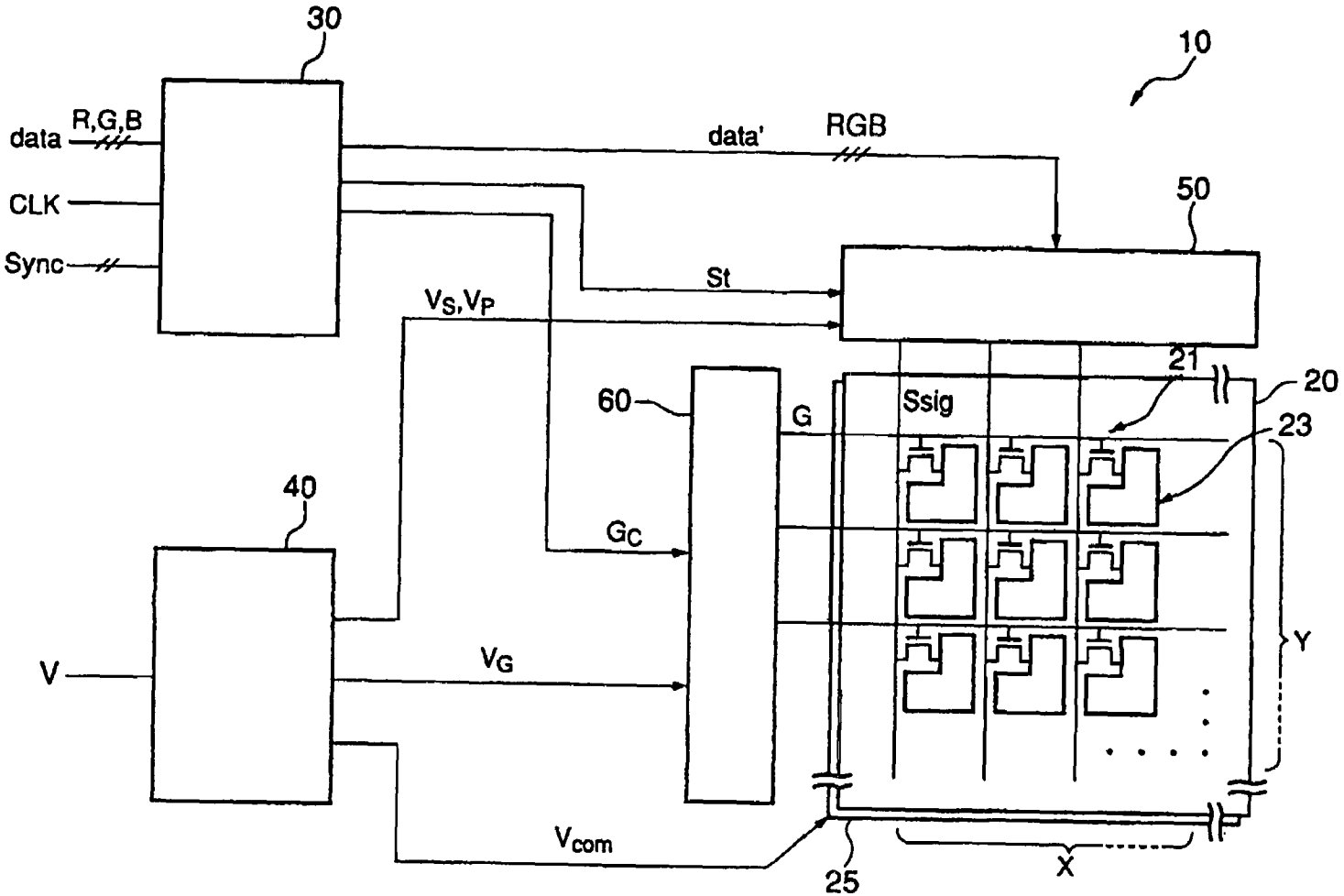
FIG. 1 is a block diagram showing a general constitution of a matrix addressing circuit applied with the present invention.

FIG. 1 shows a general constitution of a matrix addressing circuit of a liquid crystal display device according to an embodiment of the present invention.

In FIG. 1, this matrix addressing circuit 10 is arranged to drive a display panel 20 of an active matrix liquid crystal display (LCD) device on which, for example, field-effect thin film transistors (TFTs) 21 are placed in correspondence with pixels as active elements for driving pixels within a predetermined display area.

On the display panel 20, the TFTs 21 are arranged in Y rows X columns of a matrix. Gate electrodes of the TFTs 21 are connected, on a row basis, to gate bus lines running across the display area for each row horizontally and in parallel with each other, and source electrodes of the TFTs 21 are connected, on a column basis, to source bus lines running across the display area for each column vertically and in parallel with each other. Drain electrodes of the TFTs 21 are connected to their respective pixel electrodes 23, and individual pixel areas are basically determined by these pixel electrodes 23.

The display panel 20 is further provided with a common electrode 25 placed opposite to the pixel electrodes with a gap. This gap is filled with a liquid crystal medium (not shown), and the common electrode 25 extends over the entire display area in this example. The TFTs 21 are selectively turned on row by row by a gate control signal supplied through the gate bus line. The TFTs which are turned on are brought in a driving state based on pixel information signals supplied through the source bus lines. The pixel electrodes 23 are given a potential according to such a driving state by the drain electrodes. The orientation of the liquid crystal medium is controlled for each pixel electrode by an electric field determined by a difference between this given pixel electrode potential and a level of the voltage supplied to the common electrode 25. Thus, the liquid crystal medium can modulate the light originating from a backlight system (not shown) and passing through the medium to the front side (or the reflection of incident light from a front light system) in accordance with the pixel information for each pixel. Since such configurations and operations of the liquid crystal display panel are well known they are not explained further here.

The driving circuit 10 is provided with a signal control section 30, a reference voltage producing section 40, a source driver 50 as column driving means and a gate driver 60 as row driving means.

The signal control section 30 receives image data signals in the form of red (R), green (G) and blue (B) color components of the image data, dot clock signal CLK and synchronization signals SYNC including horizontal and vertical synchronization signals from signal supply means (not shown). The signal control section 30 transfers the image data signals R, G, B, also referred to as "data", in accordance with timings of the clock signal CLK and synchronization signals SYNC, to the source driver 50. Furthermore, the signal control section 30 generates a source control signal St to control the source driver 50 and a gate control signal Gc to control the gate driver 60 in accordance with the clock signal CLK and synchronization signals SYNC.

The voltage producing section 40 produces and supplies supply voltages $V_s$, $V_p$ necessary for the source driver 50 and the supply voltage $V_g$ for the gate driver 60 on the basis of a supply voltage V from a power supply system (not shown). The voltage producing section 40 further produces and supplies a voltage signal Vcom to the common electrode 25 on the display panel 20 based on the supply voltage V.

The source driver 50 is provided with a digital-analog converter for each of the color components R, G and B of the image data signals. For each pixel in a horizontal line of the display panel 20, an analog signal is generated. The level of this analog signal is corresponding to the gray level to be displayed by that pixel in accordance with the image data signals. The voltage level of each analog signal is kept constant from the beginning of one horizontal scanning cycle until the next horizontal scanning cycle starts and is supplied to the respective corresponding source bus lines. The source control signal St supplied to the source driver 50 constitutes a basis for determining timings such as a horizontal scanning cycle, timing of the digital to analog R conversion, voltage level application to the source bus lines and the like.

The gate driver 60 selectively activates the gate bus lines of the display panel 20 in accordance with the gate control signal Gc for example, selectively supplies a predetermined high voltage to the bus lines sequentially. The activated gate bus line turns on the respective TFTs connected thereto, while at the same time these TFT sources are supplied with the above-described analog signals. Therefore each TFT transfers a potential corresponding to the level of the analog signal to the corresponding part of the liquid crystal medium through its drain and pixel electrode, so as to modulate the electric field and molecular orientation state of the medium. Thus, all pixels on the corresponding line or row are optically modulated simultaneously in accordance with the analog signals for that line as described above.

The display panel 20 is generally "alternate-driven" by means of the control of the source driver 50 and gate driver 60 and of the common voltage signal Vcom, but to simplify the explanation, it will not be further mentioned here. However, it should be noted that such alternate-driving mode is included in the scope of the invention.

Figure 2:
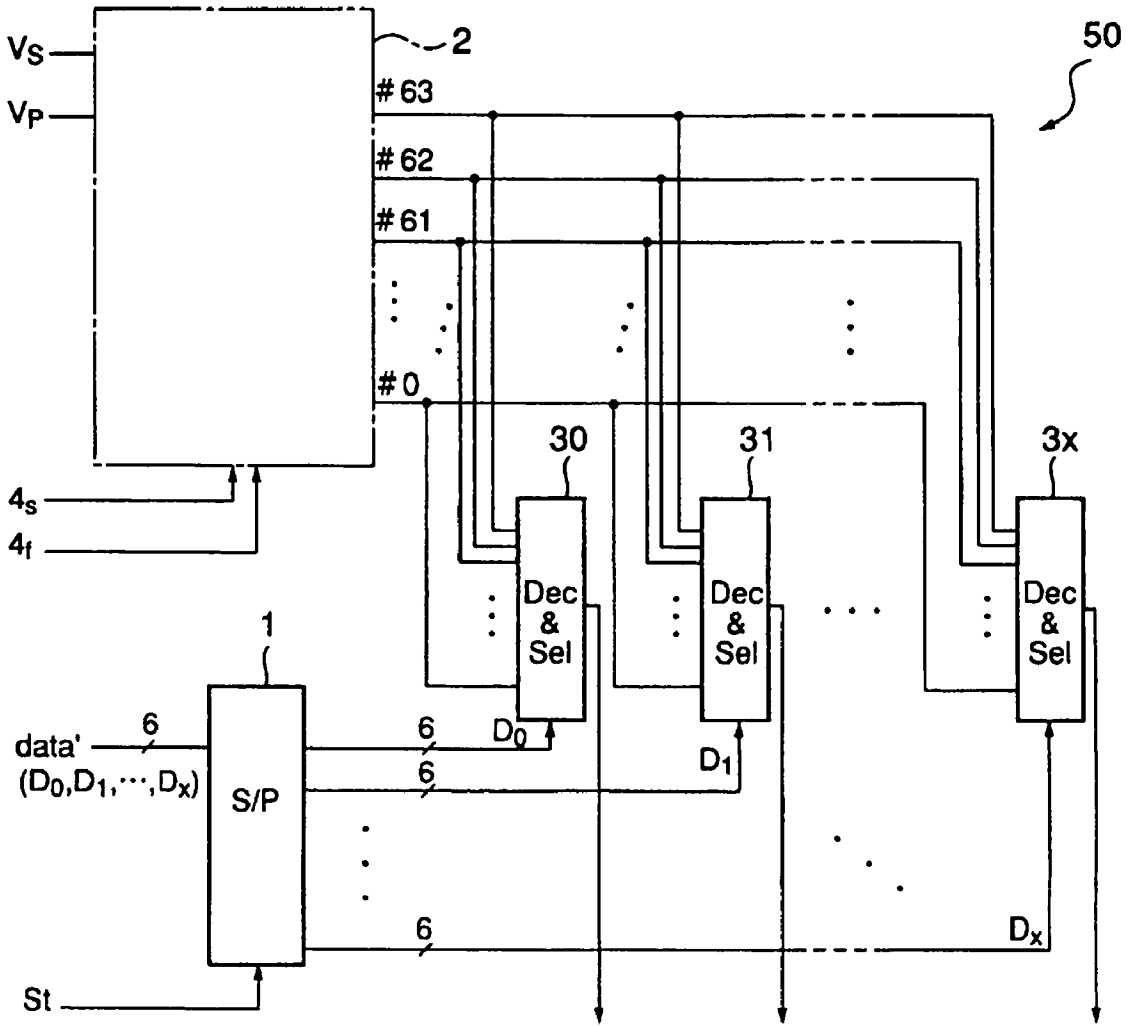
FIG. 2. is a block diagram showing a configuration of a source driver according to the present invention.

FIG. 2 shows a functional block diagram illustrating a schematic configuration of the source driver 50. Supply voltages $V_s$ and $V_p$ are supplied from the voltage producing section 40 to the gray-scale voltage producing circuit 2. The gray-scale voltage producing circuit 2 is designed to generate a maximum number (64 in this example) of gray-scale voltages (hereinafter represented as "#0 to #63") required by the display panel and the details thereof will be described later. The gray-scale voltage producing circuit 2 is also supplied with an operating mode control signal $\mathbf{4}_s$ as an operating mode signal according to the number of gray-scale levels to be represented during displaying (that is, the number of gray-scale levels necessary for a current display operation). The gray-scale voltage producing circuit 2 is further supplied with a forced mode control signal $\mathbf{4}_f$ according to the number of gray-scale levels which is to be forcibly represented irrespective of the current display operation.

Gray-scale voltages #0, #1, . . . , #63 outputted from the gray-scale voltage producing circuit 2 are supplied to the respective input terminals 30, 31, . . . , 3x of data decoding and voltage selection circuits (hereinafter referred to as "decoding and selection circuits"), where "x" denotes the number of column electrodes of the display panel 20. The decoding and selection circuits 30, 31, . . . , 3x are further supplied with "serial-parallel converted" image data signals from the data conversion circuit 1 as their respective selection control signals. The decoding and selection circuits each select any one of the gray-scale voltages in accordance with this selection control signal and supply the selected voltage to the corresponding column electrode.

Figure 3:
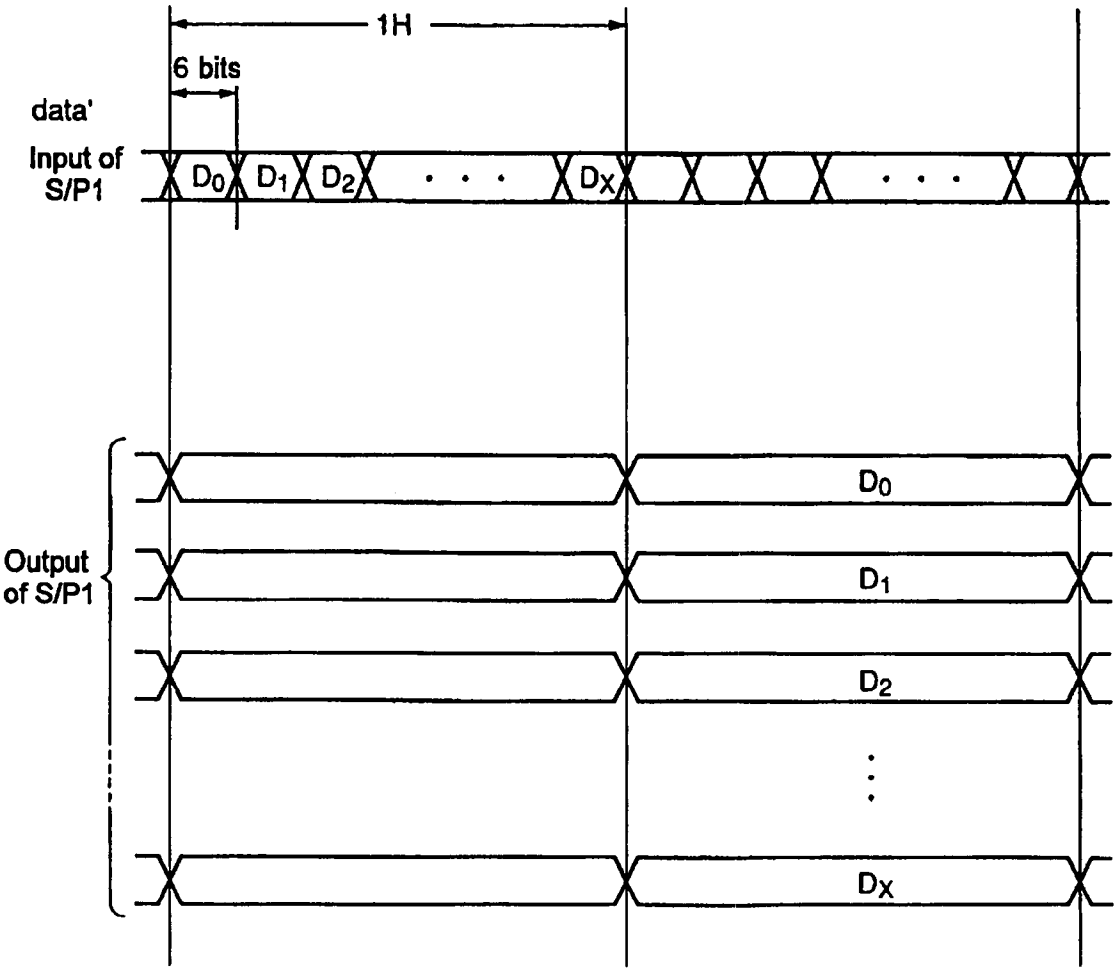
FIG. 3 is a time chart showing an operation of a data conversion circuit in the source driver of FIG. 1.

The data conversion circuit (S/P) 1 performs the function of serially receiving and capturing the input image data signal "data" and of, at the same time outputting in parallel the data signal for each horizontal scanning cycle. More specifically, as shown in FIG. 3, the input image data signal has a form in which a group of pixel data blocks $D_0$, $D_1$, $D_2$, . . . , $D_x$ (x corresponds to the number of the predetermined displayed units for one line or the number of column electrodes of the display panel 20) each consisting of 6 bits as information of one pixel arrive consecutively and sequentially on the time series. The data conversion circuit 1 holds this pixel data block group for every horizontal scanning cycle (H) based on the timing signal St while updating and outputting each of the pixel data blocks for the one horizontal scanning cycle at the same time. Therefore, the 6-bit pixel data blocks $D_0$, $D_1$, $D_2$, . . . , $D_x$ are outputted to the decoding and selection circuits 30, 31, 32, . . . , 3x simultaneously or in parallel, as shown in "output of S/P1" of FIG. 3.

Each of the decoding and selection circuits selects the corresponding gray-scale voltage in accordance with the parallel output of the 6-bit pixel data block. One pixel data block represents any one of 64 kinds of information, and therefore each decoding and selection circuit can decode the information and select any one of the gray-scale voltages #0, #1, . . . , #63 corresponding to the decoding result. The manner of such decoding and selection will be described later.

Thus, gray-scale voltages according to the image data signal "data" are updated for every horizontal scanning cycle while being supplied to the column electrodes in line sequence.

Figure 4:
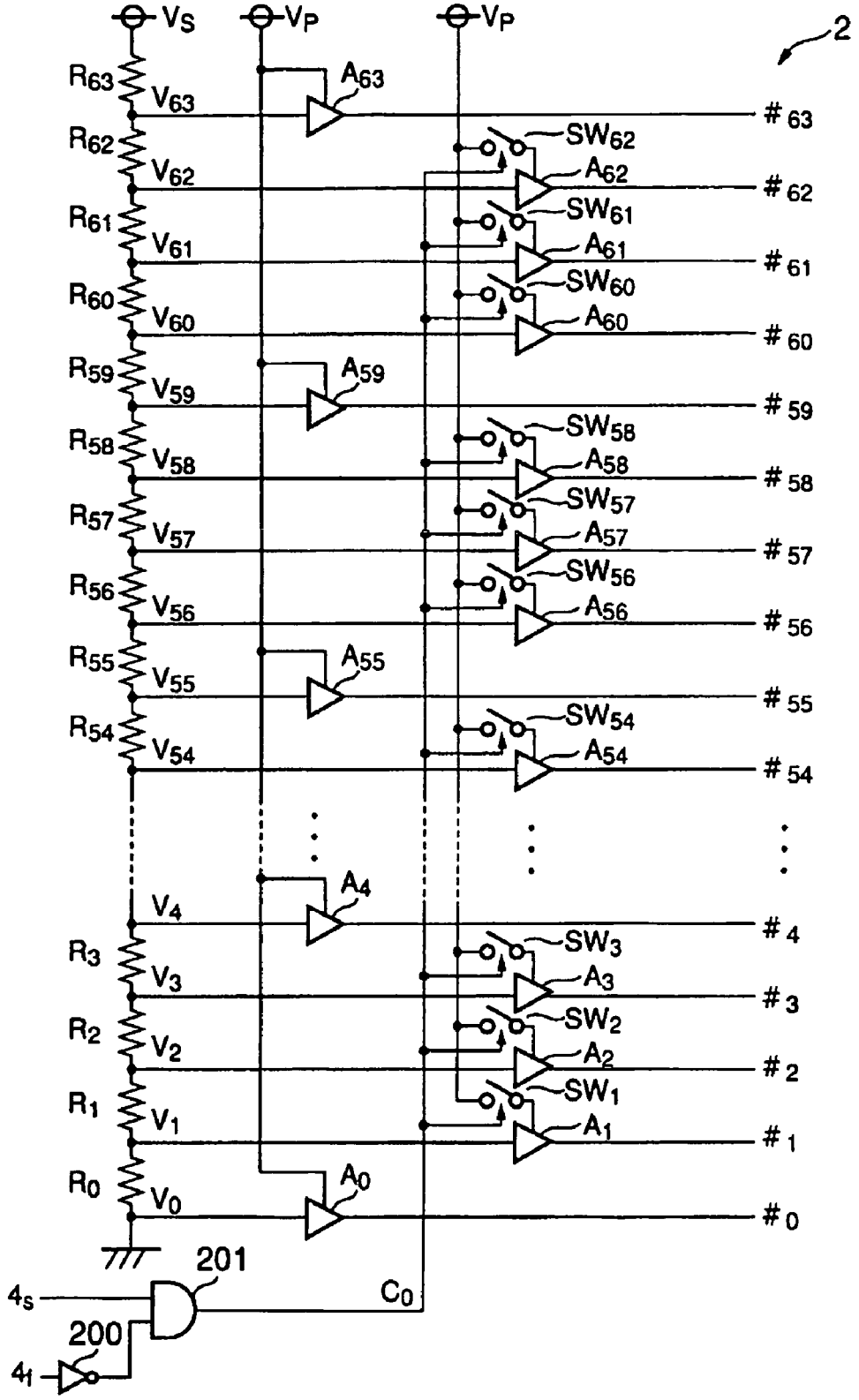
FIG. 4 is a diagram showing one structural example of a gray-scale voltage producing circuit in the source driver of FIG. 1.

FIG. 4 schematically illustrates an internal configuration of the gray-scale voltage producing circuit 2.

In FIG. 4, the basic gray-scale voltage Vs from the (preceding) voltage producing section 40 (see FIG. 1) is divided by a potential divider circuit based on series circuits of resistors $R_0$ to $R_{63}$ formed between a power supply point and a grounding point. As shown in the figure, these potential divider resistors are tapped at the common connection points and grounding point, and the divisional voltages $V_0$ to $V_{63}$ are obtained from the tap outputs. These divisional voltages are inputs of buffer amplifiers $A_0$ to $A_{63}$, respectively. These amplifiers perform predetermined amplification on the input divisional voltages (with input-output ratio of 1.0 in this example) while securing impedance matching with the column electrodes and supply outputs to the column electrodes as gray-scale voltages #0, #1, . . . , #63.

The gray-scale voltage producing circuit 2 according to this embodiment is characterized in that a predetermined number of amplifiers of these amplifiers serve as specific amplifiers and take fixed forms whereby the amplifiers are supplied with the amplifier supply voltage Vp from the voltage producing section 40, while the remainder of the amplifiers serve as unspecified amplifiers which are interruptible amplifiers corresponding to predetermined gray-scale levels to be omissible, the remainder being supplied with the supply voltage Vp selectively. As is apparent from FIG. 4, the specific amplifiers $A_0$, $A_4$, . . . , $A_{55}$, $A_{59}$, $A_{63}$ are connected to the power line in a fixed manner, while the remaining unspecified amplifiers $A_1$ to $A_3$, . . . , $A_{56}$ to $A_{58}$, and $A_{60}$ to $A_{62}$ are connected to the power line via switching circuits $SW_1$ to $SW_3$, . . . , $SW_{56}$ to $SW_{58}$, and $SW_{60}$ to $SW_{62}$, respectively. Then, these switching circuits are constructed to be controlled to ON/OFF by a common control signal $C_0$. This control signal $C_0$ is obtained from the output of an AND gate 201 that carries out the logical AND between the above described operating mode signal 4*s* and the inverted output of the above described forced mode signal 4*f* through an inversion gate 200.

In this example, the number of the specific amplifiers whose power supplies are fixed is 16 and these are selected amplifiers whose inputs are applied with the divisional voltages (specific gray-scale voltages) $V_0$, $V_4$, . . . , $V_{55}$, $V_{59}$, $V_{63}$ ranked in substantially equal intervals in the voltage range from voltage $V_0$ to $V_{63}$. On the other hand, the remaining 48 unspecified amplifiers are selectively supplied with power and these are the amplifiers whose inputs are applied with the divisional voltages (unspecific gray-scale voltages or intermediate gray-scale voltages) $V_1$ to $V_3$, . . . , $V_{56}$ to $V_{58}$, $V_{60}$ to $V_{62}$ representing intermediate values corresponding to the omissible gray-scale levels between the specific gray-scale voltages in the voltage range.

[64-Gray-Scale Displaying]

In this gray-scale voltage producing circuit 2, in the case where the number of gray-scale levels specified in a display operation when the forced mode signal 4*f* does not show the forced mode and is at a low level is 64, which is a maximum number of gray-scale levels of the display panel 20, the control signal $C_0$ is active by the control signal 4*s* that represents a state corresponding to this case (here, a high level) and the switching circuits attached to the selective power supply type amplifiers turn ON. This causes all the amplifiers of the gray-scale voltage producing circuit to be brought into operation, whereby all gray-scale voltages, that is, not only gray-scale voltages #0, #4, . . . , #55, #59, #63 but also gray-scale voltages #1 to #3, . . . , #56 to #58, #60 to #62 voltages based on the voltages $V_1$ to $V_3$, . . . , $V_{56}$ to $V_{58}$, $V_{60}$ to $V_{62}$ are outputted validly.

[16-Gray-Scale Displaying]

On the other hand, in the case where the number of gray-scale levels specified in a display operation when the forced mode signal 4*f* does not indicate a forced mode and is at a low level is 16, the control signal $C_0$ is inactive by the control signal 4*s* representing a state corresponding to this case (here, low level) and the switching circuits attached to the selective power supply type amplifiers turn OFF. This causes the amplifiers to be electrically isolated (the gray-scale voltage lines are substantially opened), thereby bringing only the persistent power supply type amplifiers $A_0$, $A_4$, . . . , $A_{55}$, $A_{59}$, $A_{63}$ into operation. Thus, only the 16 specific gray-scale voltages #0, #4, . . . , #55, #59, #63 are outputted validly.

When the forced mode signal 4*f* indicates a forced mode and is at a high level, the control signal $C_0$ is inactive and the switching circuits are turned OFF irrespective of the number of gray-scale levels specified during the display operation, so that only the 16 specific gray-scale voltages are outputted validly alike.

With the gray-scale voltage producing circuit 2 having such a configuration and in cooperation with the decoding and selection circuits 30 to 3x, the source driver 50 shown in FIG. 2 performs the following unique operations.

In the case of normal 64-gray-scale displaying, the pixel data signal "data" arrives with all 6 bits per pixel being enabled. At this time, the format of one pixel data block Dn can be expressed as shown in FIG. 5. That is, six bits $Q_0$, $Q_1$, $Q_2$, $Q_3$, $Q_4$ and $Q_5$ each having an arbitrary binary value are arranged from the LSB to the MSB sequentially. As shown in a more detailed example in FIG. 5, a relationship between the values that these bits can take and the gray-scale voltages is defined. In this example, the binary values shown by the bit trains are directly used as ranking numbers of the gray-scale voltages.

As described above, in the case of 64-gray-scale displaying, all amplifiers of the gray-scale voltage producing circuit 2 are operated and all gray-scale voltages are effectively outputted and supplied to the decoding and selection circuits 30 to 3x. Correspondingly, the decoding and selection circuits 30 to 3x also decode the pixel data block Dn based on the relationship shown in FIG. 5 so as to determine which corresponds to the content of the data and select any of the gray-scale voltages #0 to #63 supplied thereto. Since all the pixel data blocks for to one horizontal scanning cycle may designate all 64 kinds of gray-scale voltages, full shades of gray-scale displaying of image data in the format of 6 bits per pixel is achieved with all gray-scale voltages being outputted validly and by selecting any one of these gray-scale voltages for each column electrode.

Figure 6:
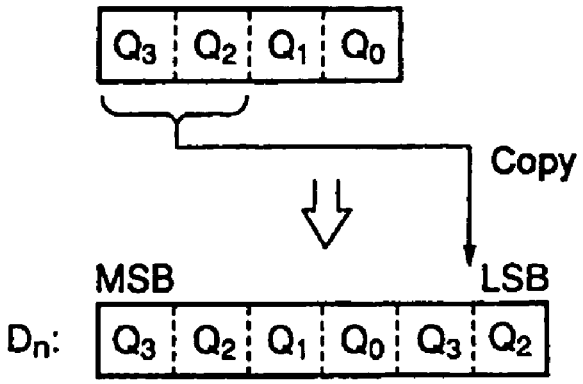
FIG. 6 is a schematic illustration showing one example of arrangement of a pixel data block in an image data signal and relations between values of the block and the corresponding gray-scale voltages during 16-gray-scale displaying.

Unlike the above, in the case of normal 16-gray-scale displaying, the pixel data signal "data" arrives with 4 bits per pixel being enabled as shown at the top of FIG. 6. The format of one pixel data block Dn at this time can be set as shown on the middle row of FIG. 6. In this example, basically without destroying the block format during the above described 64-gray-scale displaying, four bits $Q_3$, $Q_2$, $Q_1$ and $Q_0$ each having an arbitrary binary value are sequentially arranged from the MSB in the block and at the same time two higher-order bits $Q_3$ and $Q_2$ of the bit train are repeatedly located in the two bit positions on the LSB side in the block (higher-order bit relocation format). The third row of FIG. 6 shows the further details of this mode and a relationship between the values that these bits can take and gray-scale voltages is defined.

Figure 7:
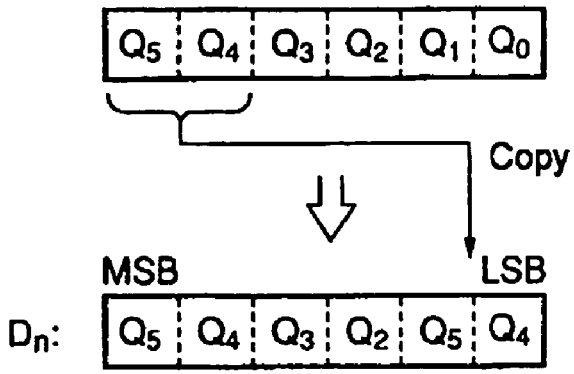
FIG. 7 is an illustration showing a structural example of a pixel data block when 6-bit image data are entered in a forced mode.

On the other hand, in the case of forced 16-gray-scale displaying, the pixel data signal "data" may arrive with all 6 bits per pixel being enabled as shown at the top of FIG. 7. The format of one pixel data block Dn at this time can be set as shown on the middle row of FIG. 7. In this example, basically without destroying the block format during the above-described 64-gray-scale displaying, four bits $Q_5$, $Q_4$, $Q_3$ and $Q_2$ each having an arbitrary binary value are sequentially arranged from the MSB in the block and at the same time two higher-order bits $Q_5$ and $Q_4$ of the original bit train instead of the original two bits $Q_1$ and $Q_0$ are repeatedly located in the two bit positions on the LSB side in the block (higher-order bit relocation format). The third row of FIG. 7 shows the further details of this mode and a relationship between the values that these bits can take and gray-scale voltages is defined.

In the case of forced 16-gray-scale displaying, when the pixel data signal "data" arrives with 4 bits per pixel being enabled as shown at the top of FIG. 6, the two higher-order bits $Q_3$ and $Q_2$ are copied to the lower-order bits as in the case of the normal 16-gray-scale displaying described above.

As a result, in both cases of 6-bit data input and 4-bit data input, the same 16-gray-scale voltages can be designated.

As described above, in the case of normal/forced 16-gray-scale displaying, only some amplifiers $A_0, A_4, \ldots, A_{55}, A_{59}, A_{63}$ of the gray-scale voltage producing circuit 2 operate and only gray-scale voltages limited to 16 kinds of #0, #4, #8, #12, #17, #21, #25, #29, #34, #38, #42, #46, #51, #55, #59 and #63 are outputted efficiently and supplied to the decoding and selection circuits. Correspondingly, the decoding and selection circuits 30 to 3x also decode the pixel data block Dn based on the relationship shown in FIGS. 6 and 7 so as to decide which corresponds to the content of the data and select any one of the gray-scale voltages #0, #4, #8, #12, #17, #21, #25, #29, #34, #38, #42, #46, #51, #55, #59 and #63 supplied. Since only these 16 kinds of gray-scale voltages can be designated even for all the pixel data blocks for one horizontal scanning cycle, selecting any one of them for each column electrode allows gray-scale displaying of image data in the format of 4 bits per pixel to be implemented appropriately.

According to the source driver 50 as described above, in the case of a display mode with fewer gray-scale levels, it is possible to electrically isolate amplifiers that output unnecessary gray-scale voltages, thus reducing power consumption. This advantage becomes noticeable for a display device whose number of intermediate tones to be displayed is variable. For example, in the case of so-called mobile or wearable devices, represented by a cellular phone, there are not so many chances where the user operates the devices, and rather the time of waiting operations is overwhelmingly long. Such devices often have a variety of functions from an operating mode requiring high display quality to an operating mode only requiring two-tone display. Thus, saving unnecessary power in such a waiting operation and display mode with a small-number of intermediate tones is suitable for an actual operation and reasonable, without forcing any sacrifice of the actual operation, etc. and is therefore quite desirable.

As is apparent from the relationship between the bit trains and gray-scale voltages shown in FIGS. 6 and 7, the minimum gray-scale voltage #0 and the maximum gray-scale voltage #63 are used even for this 16-gray-scale displaying just as with the 64-gray-scale displaying. Then, gray-scale voltages are selected in such a way as to be ranked in substantially the same intervals between the minimum gray-scale voltage and the maximum gray-scale voltage. This embodiment realizes selections (ranking) of such gray-scale voltages in the above described higher-order 2-bit relocation format. Adopting such a format makes it possible to use both the maximum and minimum gray-scale voltages, and to make full use of the whole width of the gray-scale voltage range efficiently, thereby simply selecting gray-scale voltages ranked in substantially the same intervals in the voltage range.

Figure 8:
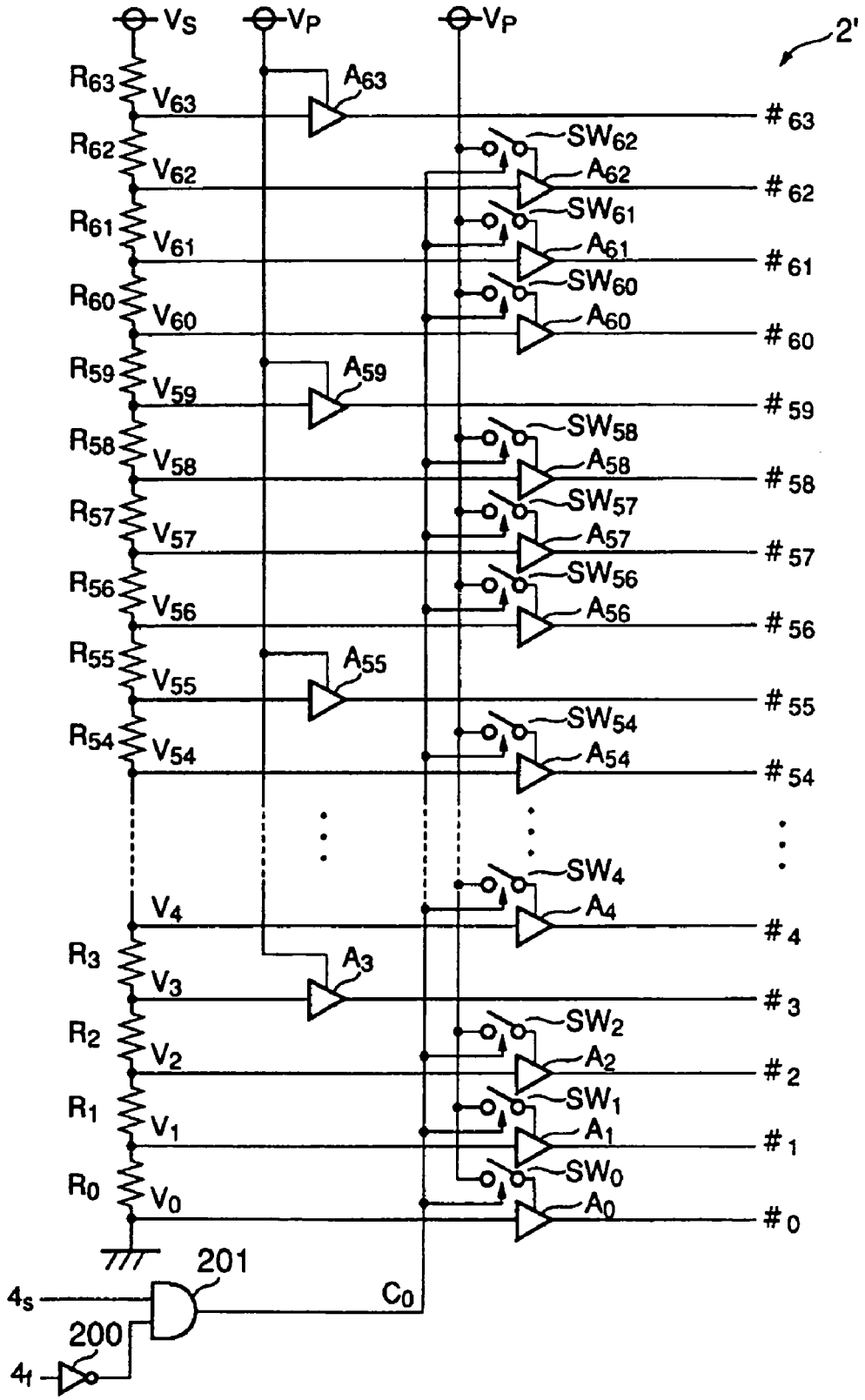
FIG. 8 is a diagram showing a modification of the arrangement of FIG. 4.

This embodiment is intended to select gray-scale voltages during 16-gray-scale displaying in the higher-order 2-bit relocation format, but there are also other selection methods. FIG. 8 shows a configuration of a gray-scale voltage producing circuit 2' according to such a modified selection method, wherein the same components as those in FIG. 4 are assigned the same reference symbols.

The configuration in FIG. 8 differs from that in FIG. 4 in that an amplifier $A_{63}$ is selected as an amplifier to be constantly powered so as to provide constant output of the maximum voltage $V_{63}$ and further amplifiers to be constantly powered are selected every four voltage lines using the amplifier $A_{63}$ as the reference. This difference is made clear in FIGS. 9 and 10.

Figure 9:
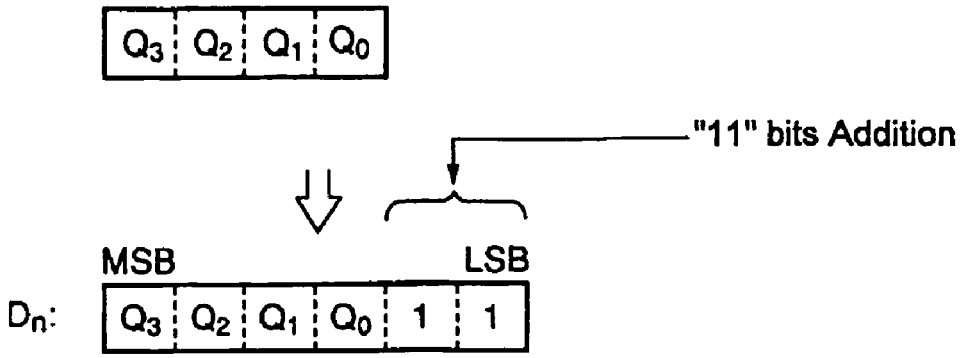
FIG. 9 is a schematic illustration showing another example of arrangement of a pixel data block in an image data signal and relations between values of the block and the corresponding gray-scale voltages during 16-gray-scale displaying, which are used for the arrangement of FIG. 8.
Figure 10:
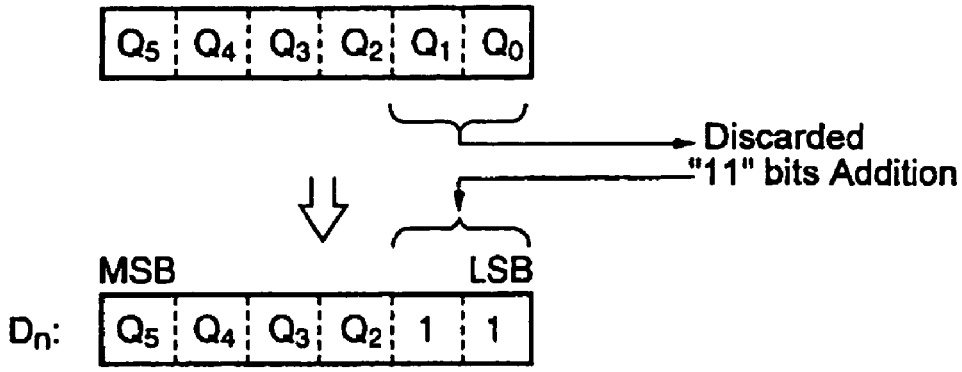
FIG. 10 is an illustration showing a structural example of a pixel data block when 6-bit image data are entered in a forced mode, which is used for the arrangement of FIG. 8.

As in the cases of FIGS. 6 and 7, FIGS. 9 and 10 show the format of a pixel data block Dn with an example of gray-scale voltages to be selected and a decoding rule of the decoding and selection circuit. In FIG. 9, basically without destroying the above-described block format during the 64-gray-scale displaying, four bits $Q_3$, $Q_2$, $Q_1$ and $Q_0$ each having an arbitrary binary value are sequentially located from the MSB side in the block and at the same time a fixed value "11" is assigned to the two bit positions on the LSB side in the same block (maximum-base lower-order bit fixed format). FIG. 10 shows data processing carried out when six bits $Q_5$, $Q_4$, $Q_3$, $Q_2$, $Q_1$ and $Q_0$ are supplied as the input pixel data block in the case of forced 16-gray-scale displaying. In the processing, the original higher-order bit train $Q_5$, $Q_4$, $Q_3$ and $Q_2$ remains unchanged, while a fixed value "11" is assigned to the lower bits instead of the lower-order bit train $Q_1$ and $Q_0$ (maximum-base lower-order bit fixed format, again).

According to this, when the higher-order 4-bit train indicates a maximum value, the 6-bit block indicates a maximum value, but even if the higher-order 4-bit train indicates a minimum value, the 6-bit block does not indicate a minimum value. Furthermore, as in the cases of FIGS. 6 and 7, during the forced 16-gray-scale displaying, the same 16-gray-scale voltages can be designated for both cases of 6-bit data input and 4-bit data input as a result.

Figure 11:
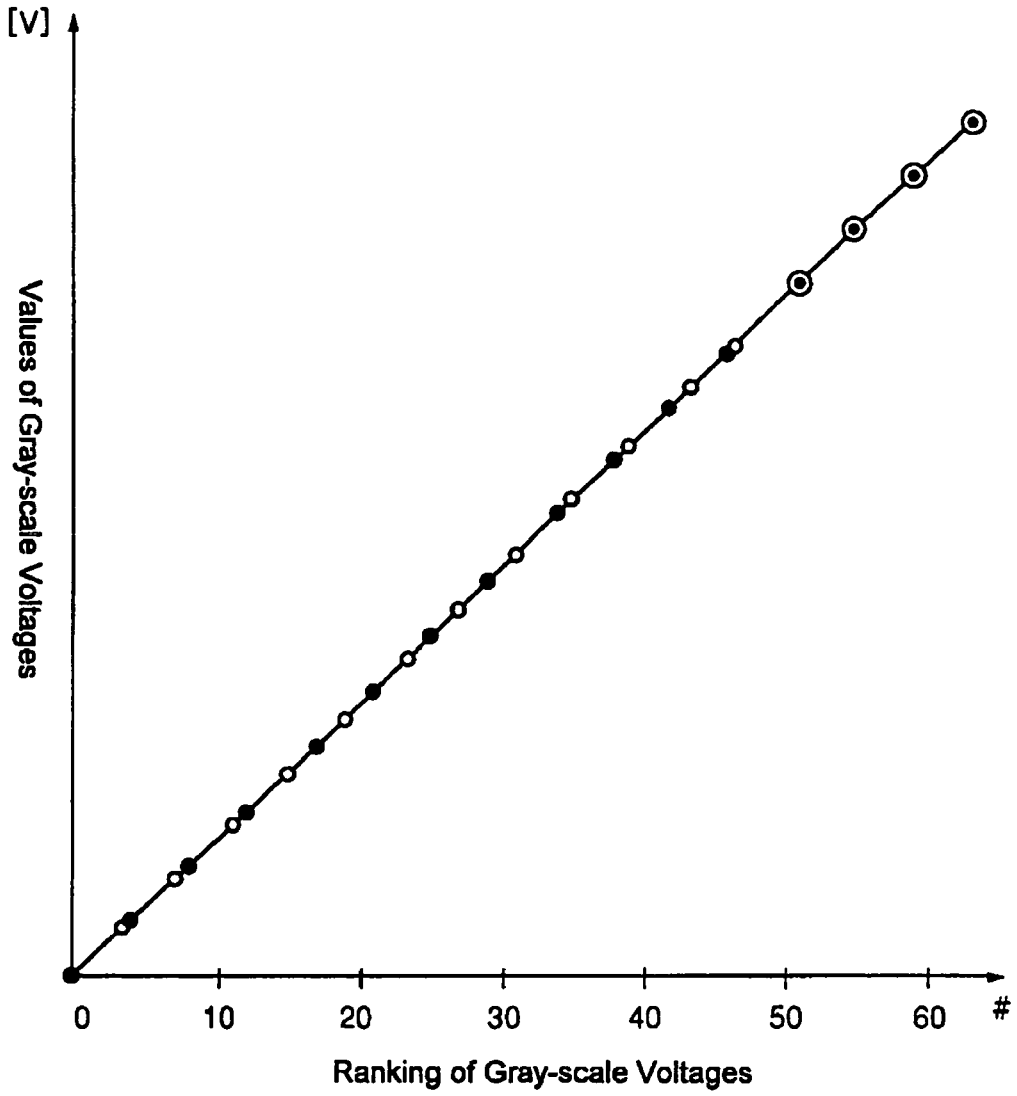
FIG. 11 is a graph showing relations between values of gray-scale voltages and their ranking for comparing one arrangement example and the other arrangement example of an image data block.

As is apparent from these examples, the gray-scale voltages whose ranking diminishes just every 4 steps from the maximum gray-scale voltage #63 downward are selected. For a comparison between this case and the cases in FIGS. 6 and 7, seeing FIG. 11 is desired. FIG. 11 shows ranking of gray-scale voltages within the overall gray-scale voltage range (this is an example where the gray-scale voltage changes completely linearly). Black bullets indicate gray-scale voltages according to the higher-order 2-bit relocation format in FIGS. 6 and 7, white bullets gray-scale voltages according to the maximum-base two lower-order bit fixed format in FIGS. 9 and 10. As is apparent from this, the former adopts both the maximum value and minimum value within the gray-scale voltage range for the gray-scale voltages, and selects gray-scale voltages positioned in substantially the same intervals within the range as the other gray-scale voltages. In contrast, the latter adopts the maximum value as the gray-scale voltage, and selects gray-scale voltages positioned in completely equal intervals within the voltage range from the maximum value using the maximum value as the reference as the other gray-scale voltages.

The former is more advantageous in the sense that a certain limited voltage range is effectively used and no gray-scale display range is sacrificed (allowing a more comprehensive intermediate tone expression as a result). However, depending on the system applied, there is also a possibility that relocation processing of the higher-order two bits in the former may complicate the configuration, for example, require a memory function specific to that processing, and therefore the latter may also be advantageous in terms of simplification of data processing. Furthermore, in the latter, intermediate tone displaying corresponding to the gray-scale voltages #0, #1 and #2 is discarded during the 16-gray-scale displaying, but the lowest gray-scale voltage #3 is as low as negligible and switching from the 64-gray-scale displaying to the 16-gray-scale displaying would originally mean that the intermediate tone to be displayed becomes rougher, and therefore this discarding does not matter in many cases.

Furthermore, as a further modification example instead of the configuration in FIG. 8, the amplifier $A_0$ may be selected as an amplifier to be constantly powered so as to keep the fixed output of the minimum voltage $V_0$ as a specific gray-scale voltage and amplifiers which are constantly powered and output other specific gray-scale voltages may be selected for every four voltage lines using the amplifier $A_0$ as the reference.

Figure 12:
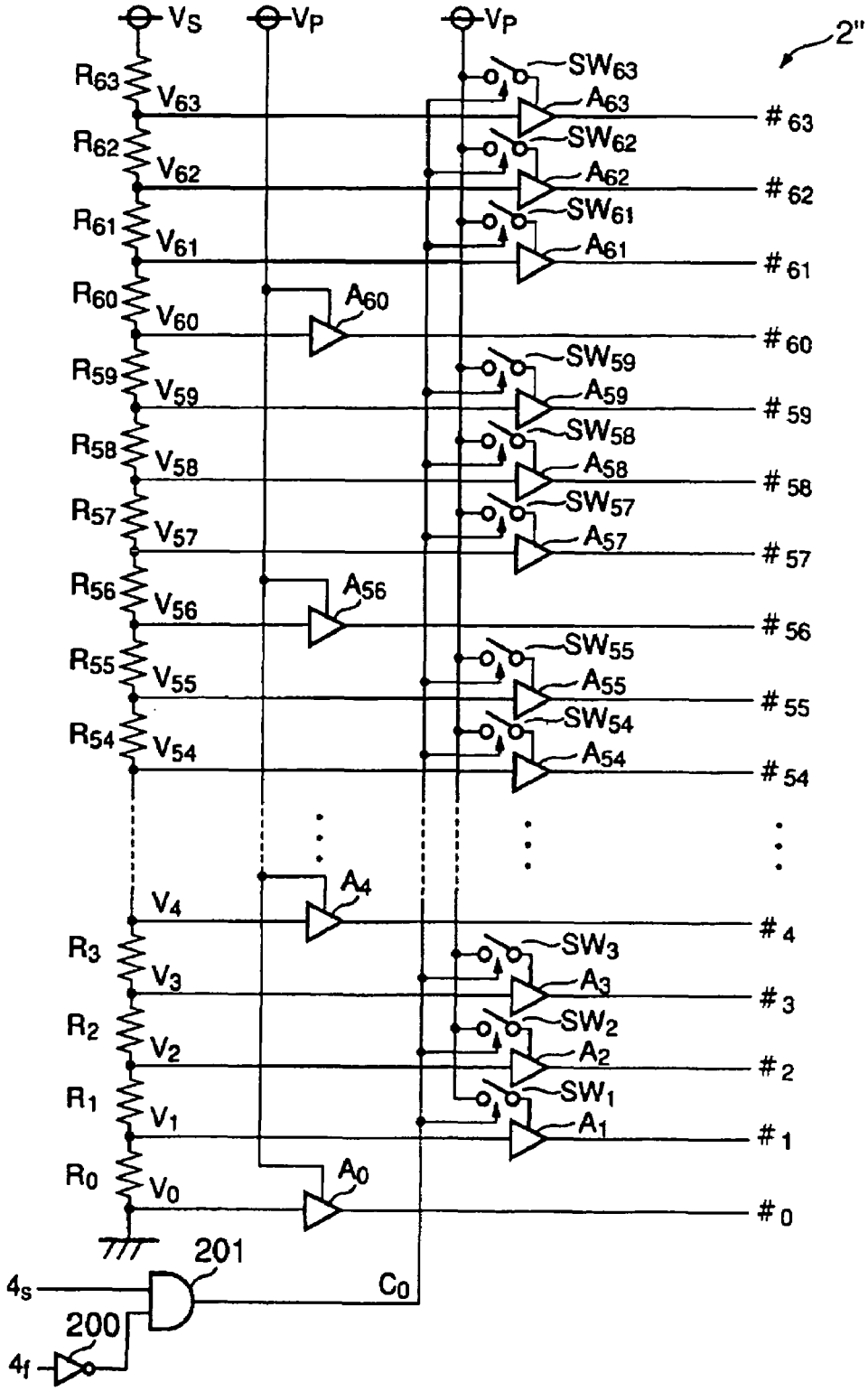
FIG. 12 is a diagram showing a modification of the arrangement of FIG. 4, which is used instead of the arrangement of FIG. 8.

FIG. 12 shows a configuration of a gray-scale voltage producing circuit 2" according to such a modification example and the same components as those in FIG. 4 are assigned the same reference symbols.

In FIG. 12, the amplifier $A_0$ is selected as the amplifier to be constantly powered so as to make the fixed output of the minimum voltage $V_0$ instead of the maximum voltage $V_{63}$ and amplifiers which are constantly powered are selected for every four voltage lines using the amplifier $A_0$ as the reference. This is made clear in FIGS. 13 and 14.

Figure 13:
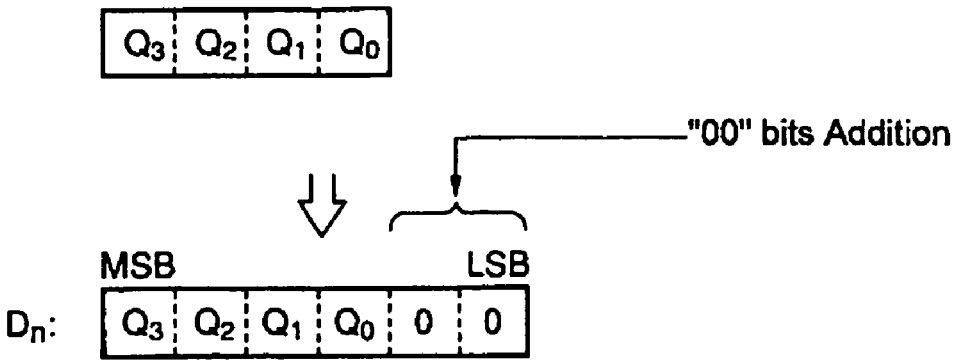
FIG. 13 is a schematic illustration showing the other example of arrangement of a pixel data block in an image data signal and relations between values of the block and the corresponding gray-scale voltages during 16-gray-scale displaying, which are used for the arrangement of FIG. 12.
Figure 14:
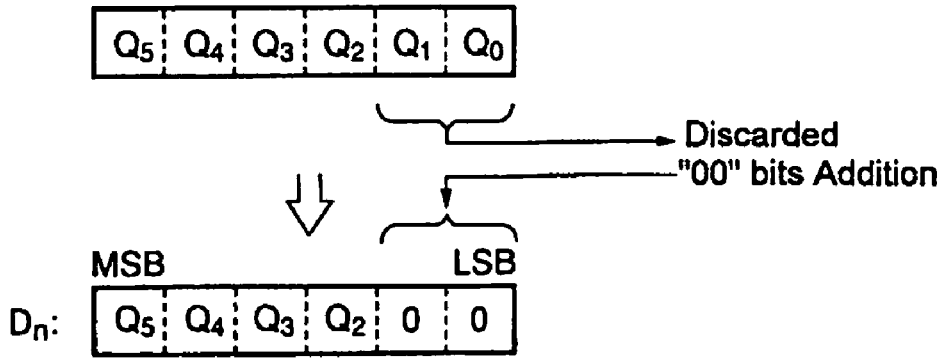
FIG. 14 is an illustration showing a structural example of a pixel data block when 6-bit image data are entered in a forced mode, which is used for the arrangement of FIG. 12.

As in the cases of FIGS. 6 and 7 or FIGS. 9 and 10, FIGS. 13 and 14 show a format of a pixel data block Dn, with an example of gray-scale voltages to be selected and a decoding rule of the decoding and selection circuit. In FIG. 13, basically without destroying the above-mentioned block format during the 64-gray-scale displaying, four bits of $Q_3$, $Q_2$, $Q_1$ and $Q_0$ each having an arbitrary binary value are sequentially located from the MSB side in the block and at the same time a fixed value "00" is assigned to the two bit positions on the LSB side in the same block (minimum-base lower-order bit fixed format). FIG. 14 shows data processing carried out when six bits of $Q_5$, $Q_4$, $Q_3$, $Q_2$, $Q_1$ and $Q_0$ are supplied as the input pixel data block in the case of forced 16-gray-scale displaying, wherein and while the original higher-order bit train $Q_5$, $Q_4$, $Q_3$ and $Q_2$ remains unchanged, a fixed value "00" is now assigned instead of the lower-order bit train $Q_1$, $Q_0$ (minimum-base lower-order bit fixed format, again).

According to this, when the higher-order 4-bit train indicates a minimum value, the 6-bit block indicates a minimum value, but even if the higher-order 4-bit train indicates a maximum value, the 6-bit block does not indicate a maximum value. Furthermore, as in the case of the foregoing examples, during the forced 16-gray-scale displaying, the same 16-gray-scale voltages can be designated for both cases of 6-bit data input and 4-bit data input as a result.

According to this example, gray-scale voltages whose ranking increases just every 4 steps from the minimum gray-scale voltage #0 upward are selected. In reference to FIG. 11, all white bullets in the cases of FIGS. 8 to 10 are shifted 4 steps toward the origin on the straight line.

Therefore, this is advantageous in simplifying data processing as in the cases of FIGS. 8 to 10. Furthermore, intermediate tone displaying corresponding to the gray-scale voltages #63, #62 and #61 is discarded during the 16-gray-scale displaying, but the highest gray-scale voltage #60 is sufficiently high and these voltages can be ignored, and therefore this example is sufficiently practical.

The explanations so far have described examples where the lower-order bits are fixed to "11" and "00" in the lower-order bit fixed format, but other values such as "01" and "10" can also be fixed as the lower-order bits. That is, with these lower-order bits of "01" and "10", neither the maximum-base nor the minimum-base as described above is obtained, but a format is provided wherein a value slightly deviating from the maximum value or minimum value is the reference. This means a common feature in respect that specific gray-scale voltages are selected in equal intervals by determining one reference value so that much the same effects and advantages can be obtained.

The data arrangement processing in the above-described higher-order bit relocation format and lower-order bit fixed format can be carried out with appropriate means provided on the supply source side of the data sequence "data".

Figure 15:
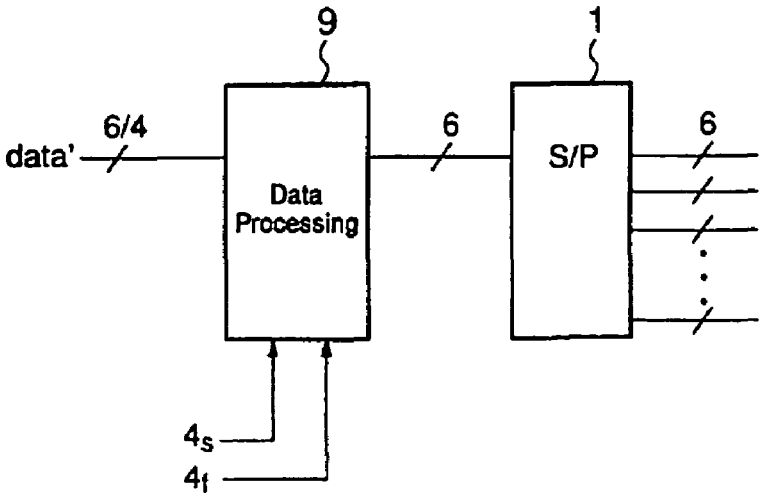
FIG. 15 is a block diagram showing one example of processing way for a pixel data block.

FIG. 15 illustrates such an example, wherein a data processing circuit 9 whose input is applied with the data sequence "data" is provided before the data conversion circuit 1. The data processing circuit 9 basically receives the control signals 4*s* and 4*f*, then processes the 6-bit train or 4-bit train of the input data train "data" in the higher-order bit relocation format or lower-order bit fixed format in accordance with these control signals to always generate a 6-bit output data train and to transfer the data train to the data conversion circuit 1. This has an advantage that the data conversion circuit 1 and the selection circuits 30 to 3x are not required to change according to the present invention.

Alternatively, since the decoding rule itself of the selection circuits 30 to 3x is certain, it is also possible to provide an arrangement immediately before the selection circuit, which, for example, switches to a mechanism to make up 2 missing bits for a 6-bit selection control signal in the case of 4-bit data in response to the control signal 4*s*, thus implementing equivalent data processing.

Figure 16:
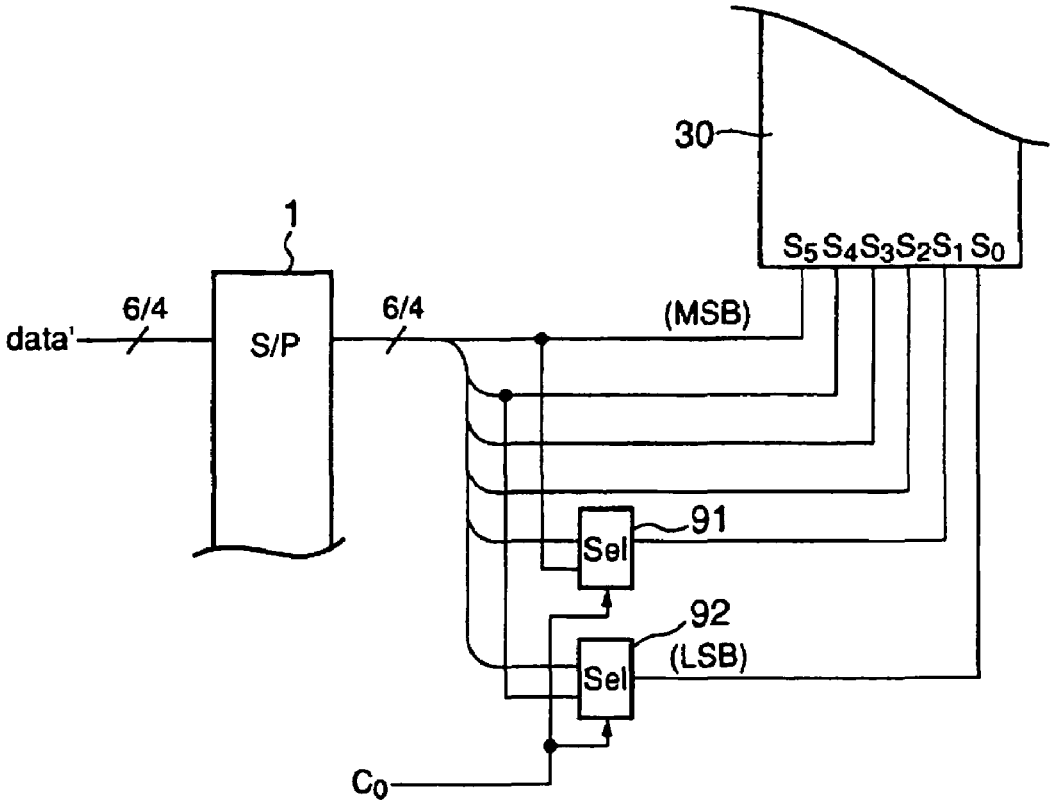
FIG. 16 is a block diagram showing another example of processing way for a pixel data block.

FIG. 16 shows such an example and illustrates part of a system implementing data processing in the higher-order bit relocation format of FIGS. 6 and 7. Here, the system is provided with selectors 91 and 92 which receive the LSB side 2 bits of the 6 bits of the output of the data conversion circuit 1 as their inputs, respectively and receive the MSB side 2 bits as their other inputs, respectively and further receive the above-described control signal $C_0$ as their control inputs. Furthermore, the higher-order 4-bit outputs of the data conversion circuit 1 are directly coupled with the higher-order 4-bit inputs for selection control of the selection circuit on one hand, and the outputs of the selectors 91 and 92 are supplied to the lower-order 2-bit inputs for selection control of the selection circuit, respectively, on the other. The selectors 91 and 92 can select and output either one input according to the above-described control signal $C_0$, and can thereby select and output the MSB side 2 bits of the output 6 bits of the data conversion circuit 1 during the normal/forced 16-gray-scale displaying and attain the higher-order bit relocation.

By the way, FIG. 16 only illustrates the configuration of one selection circuit (the first selection circuit 30), but the same configuration applies to other selection circuits. Furthermore, in the case of the lower-order bit fixed format, predetermined fixed bits such as "11" bits, etc. may be used as the other inputs of the selectors 91 and 92.

There may be a number of other embodiments for adapting the selection circuits to changes in the output fashion of the gray-scale voltage producing circuit 2 due to the switching of the number of displayed gray-scale (e.g., data processing, etc. in the data conversion circuit 1).

Figure 17:
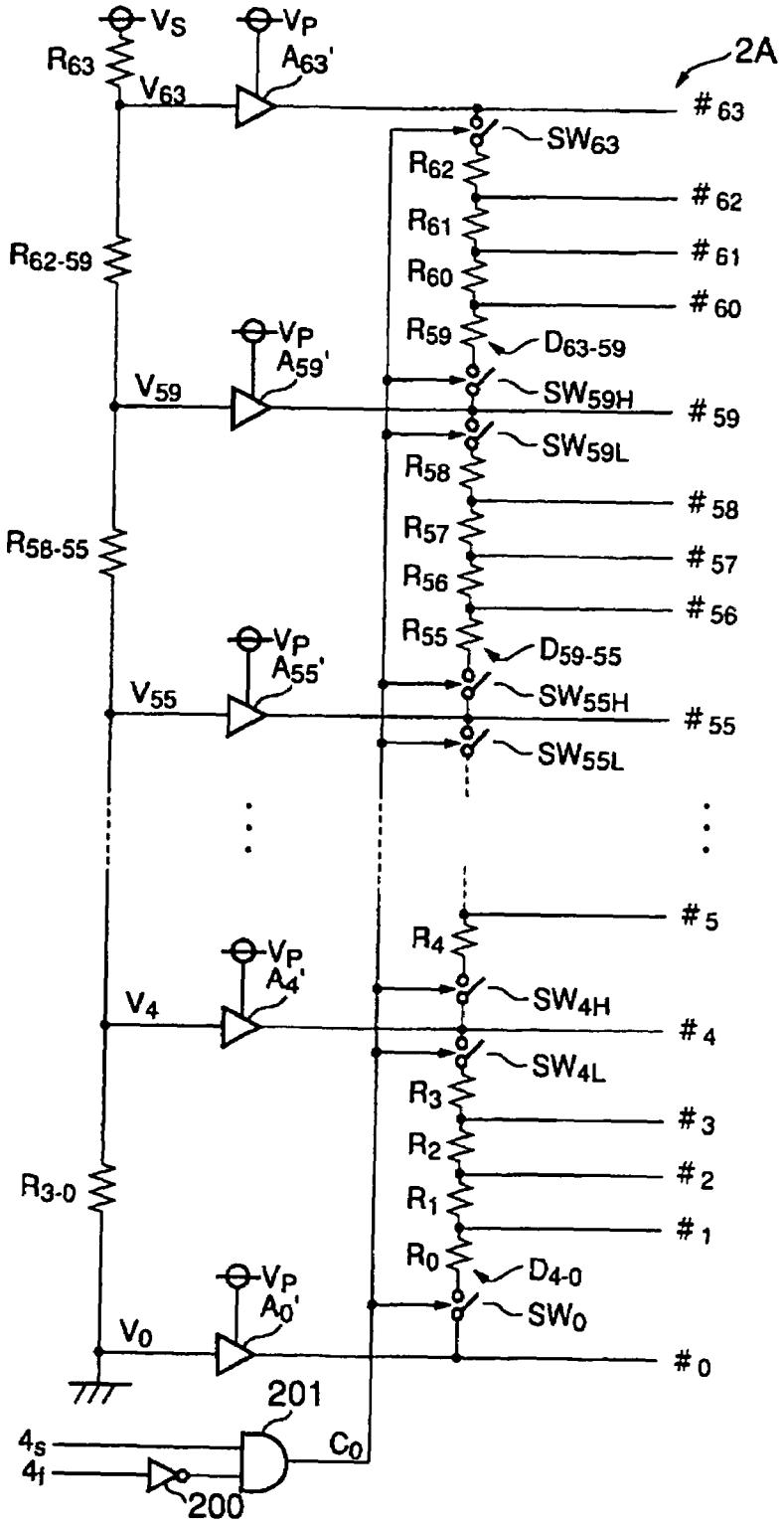
FIG. 17 is a diagram showing the other structural example of gray-scale voltage producing circuit in the source driver.

FIG. 17 shows a gray-scale voltage producing circuit 2A used for the source driver of another embodiment according to the present invention.

In FIG. 17, the base gray-scale voltage Vs from the (preceding) voltage producing section 40 (see FIG. 1) is divided by coarse potential divider circuits based on series circuits of resistors $R_{63}$, $R_{62\text{-}59}$, $R_{58\text{-}55}$, . . . , $R_{3\text{-}0}$ formed between the power supply point and grounding point. As shown in FIG. 17, the common connection points of these potential dividing resistors and the grounding point are led out as taps and 16 coarsely divisional voltages (basic gray-scale voltages) $V_0$, $V_4$, . . . , $V_{55}$, $V_{59}$, $V_{63}$ are obtained from these tap outputs, respectively. These coarsely divisional voltages are inputted to 16 buffer amplifiers $A_0'$, $A_4'$, . . . , $A_{55}'$, $A_{59}'$, $A_{63}'$, respectively. These amplifiers perform predetermined amplification on the input divisional voltages while securing impedance matching with the corresponding column electrodes as with the above-mentioned embodiments, and supply outputs as gray-scale voltages #0, #4, . . . , #55, #59, #63.

Fine control potential divider circuits $D_{4\text{-}0}$, . . . , $D_{59\text{-}55}$, $D_{63\text{-}59}$ based on series circuits made up of 4 or 5 resistors are formed between an output line of one buffer amplifier and that of the next buffer amplifier. Furthermore, both ends of these fine potential divider circuits are connected to the output lines of the amplifiers through switching circuits $SW_0$, $SW_{4L}$, $SW_{4H}$, . . . , $SW_{55L}$, $SW_{55H}$, $SW_{59L}$, $SW_{59H}$ and $SW_{63}$. Each switching circuit is controlled to ON/OFF by a control signal $C_0$ which may be equivalent to the control signal in the foregoing embodiment.

When the respective switching circuits are closed, the gray-scale voltages #4, . . . , #55, #59 and #63 are divided by the fine potential divider circuits. As shown in FIG. 17, the common connection points of these potential divider resistors in the fine divider circuits are led out as taps, and the finely divisional voltages (intermediate gray-scale voltages) #1 to #3, . . . , #56 to #58, #60 to #62 each having a value between the above-described coarsely divisional voltages are obtained from these tap outputs, respectively. These finely divisional voltages are supplied to the column electrodes together with the outputs #0, #4, . . . , #55, #59 and #63 of the above-described coarsely divisional voltages $V_0$, $V_4$, . . . , $V_{55}$, $V_{59}$, and $V_{63}$.

This embodiment is intended to directly supply the outputs of the amplifiers to the column electrodes for the predetermined 16 gray-scale voltages, and to obtain other gray-scale voltages by (more finely) dividing the predetermined gray-scale voltages while electrically isolating the fine potential divider circuits from this gray-scale voltage producing circuit using the switching circuits when the other gray-scale voltages are unnecessary.

According to such configuration, turning OFF the switching circuits prevents the fine potential divider circuits from being load on the amplifiers during 16-gray-scale displaying, and therefore the amplifiers need not supply currents to the fine potential divider circuits. This allows the effect of reducing power consumption to be exhibited as in the case of the aforementioned embodiments.

This embodiment is also based on the aforementioned higher-order bit relocation format. That is, specific gray-scale voltages outputted through the amplifiers are gray-scale voltages with the ranking numbers shown in FIGS. 6 and 7 and other gray-scale voltages are based on the divisional outputs of the fine potential divider circuits corresponding to the other ranking numbers.

Figure 18:
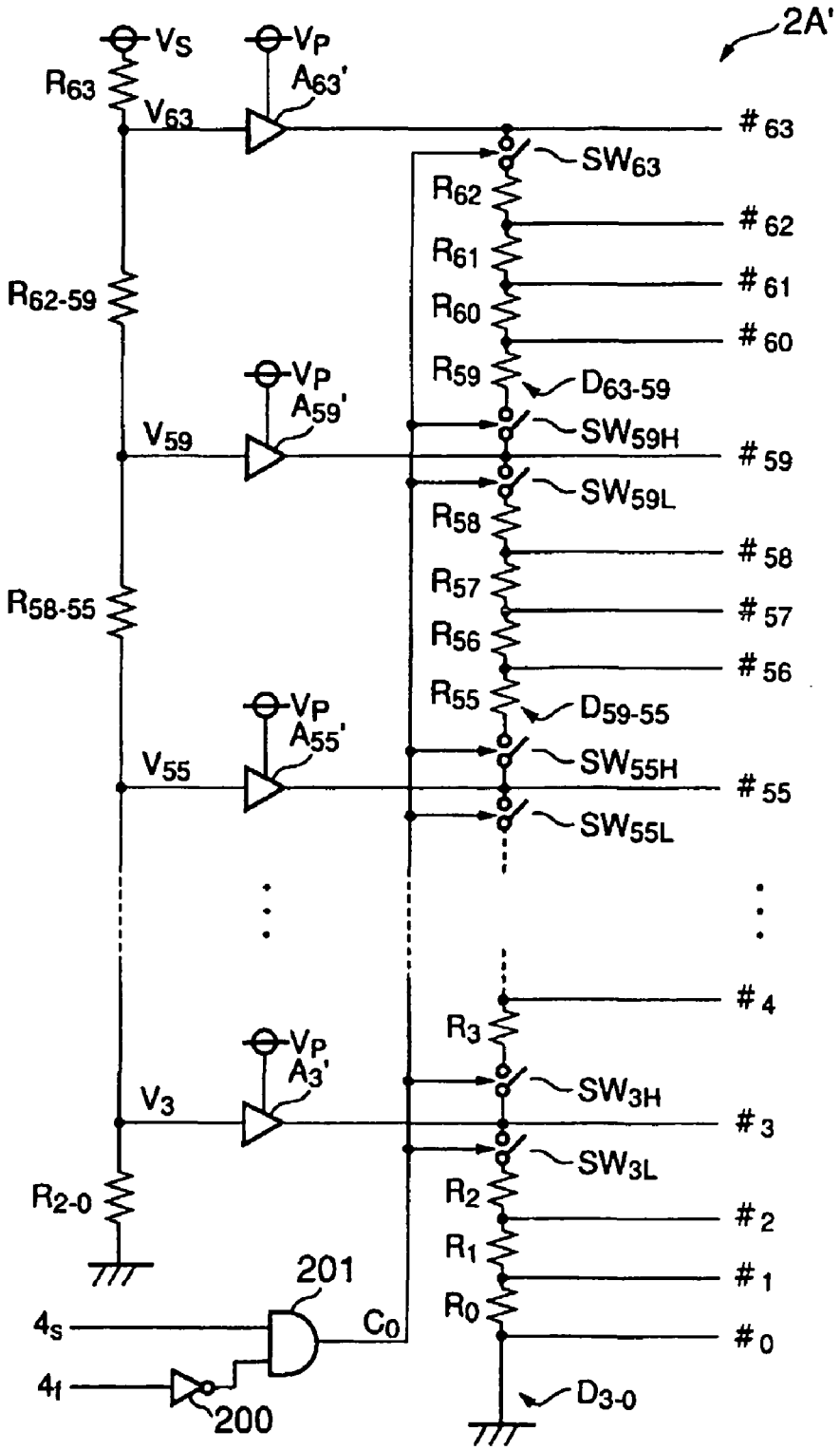
FIG. 18 is a diagram showing a modification of a constitution of FIG. 17.

The configuration of this embodiment may also be modified to a configuration based on the maximum-base lower-order bit fixed format mentioned already. FIG. 18 shows a gray-scale voltage producing circuit 2A' according to this modification. The configuration in FIG. 18 complies with the maximum-base lower-order 2-bit fixed format shown in FIGS. 9 and 10, but instead of this format, not only the minimum-base lower-order 2-bit fixed format shown in FIGS. 13 and 14 but also other formats as based on the lower-order bit fixed format may be used. Those configurations are obvious for those skilled in the art from the above description.

In the above embodiment, the control signal 4*s* as an operating mode signal can be received, e.g. by providing an external input terminal for the driving circuit as means for supplying the signal 4*s*. This makes it possible to introduce therein a signal being obtained from the CPU or the like in the display device and being indicative of a state corresponding to the number of gray-scale levels to be displayed.

Furthermore, the control signal 4*f* as a forced mode signal can also be received in the same manner and the user can perform input operation to set, for example, a simple display (power-saving) mode to determine a state of the signal 4*f*. Alternatively or in addition, when the CPU or the like in the display device determines that the amount of its battery charge is equal to or lower than a predetermined level, it may make this control signal 4*f* active so as to automatically change the operating mode to a forced simple display (power-saving) mode.

Up to this point, representative embodiments and their modifications have been described, but the present invention is not limited to them and it goes without saying that a variety of modified embodiments can also be found. For example, the gray-scale voltages need not follow the pattern as shown in FIG. 11, but can also take values having a predetermined compensation characteristic and the present invention is applicable not only to a case of 64- and 16-gray-scale voltages but also to a case where the different number of gray-scale voltages are generated.

The present invention is not limited to two kinds of display modes and may be intended to electrically isolate output circuits for similarly appropriate gray-scale voltages for the respective display modes of, for example, 64-gray-scale levels, 32-gray-scale levels and 16-gray-scale levels, etc. In this case, such electrical isolation is performed hierarchically.

Figure 19:
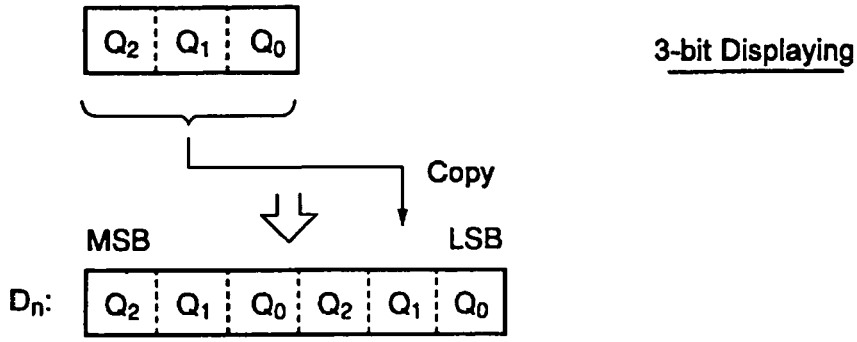
FIG. 19 is a schematic illustration showing an arrangement of a pixel data block and relations between values of the block and the corresponding gray-scale voltages during a 3-bit displaying mode.
Figure 20:
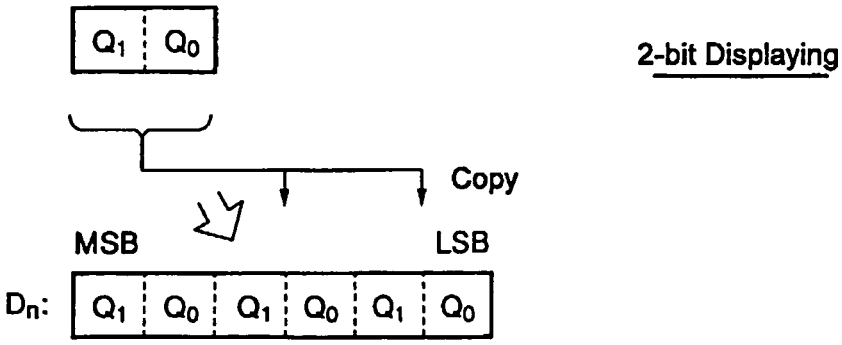
FIG. 20 is a schematic illustration showing an arrangement of a pixel data block and relations between values of the block and the corresponding gray-scale voltages during a 2-bit displaying mode.
Figure 21:
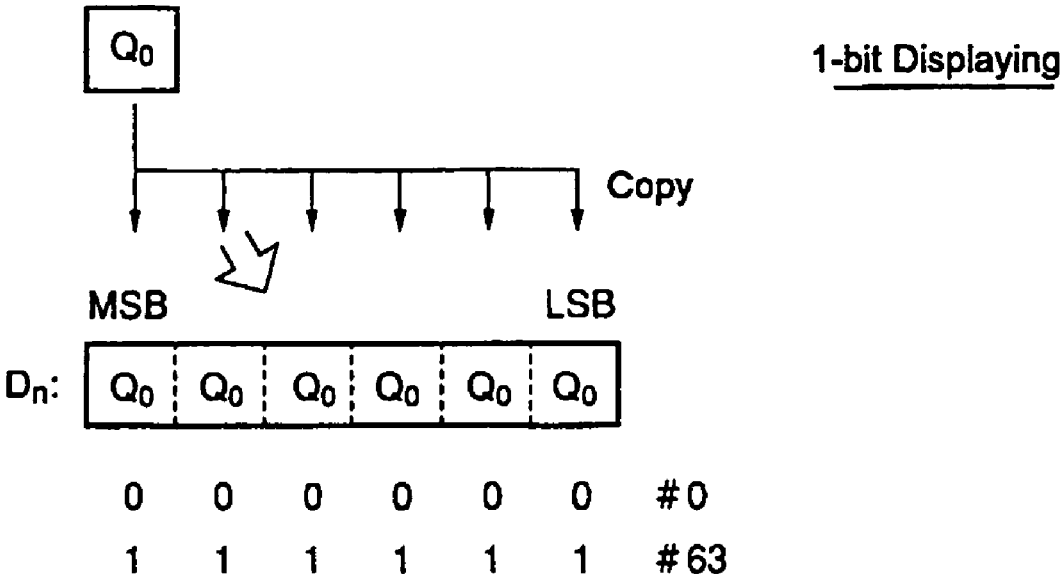
FIG. 21 is a schematic illustration showing an arrangement of a pixel data block and relations between values of the block and the corresponding gray-scale voltages during a 1-bit displaying mode.

FIG. 19 shows an arrangement of the data block Dn in displaying of 3-bit pixel data according to the higher-order bit relocation format, that is, the 8-gray-scale displaying and the resultant ranking numbers for the specific gray-scale voltages. In this example, all three input bits are assigned to the three bits which are missing in the six bits that make displaying the maximum number of gray-scale levels in the display device. FIG. 20 also shows an arrangement of the data block Dn in displaying of 2-bit pixel data according to the same higher-order bit relocation format, that is, the 4-gray-scale displaying and the resultant ranking numbers for the specific gray-scale voltages. In this example, two input bits are assigned to the missing four bits twice repeatedly. FIG. 21 further shows an arrangement of the data block Dn in displaying of 1-bit pixel data according to yet the same higher-order bit relocation format, that is, the 2-gray-scale displaying and the resultant ranking numbers of the specific gray-scale voltages. In this example, one input bit is assigned to all the five bits which are missing. Not only the higher-order bit relocation format but also the lower-order bit fixed format may be adopted for each display mode.

Figure 22:
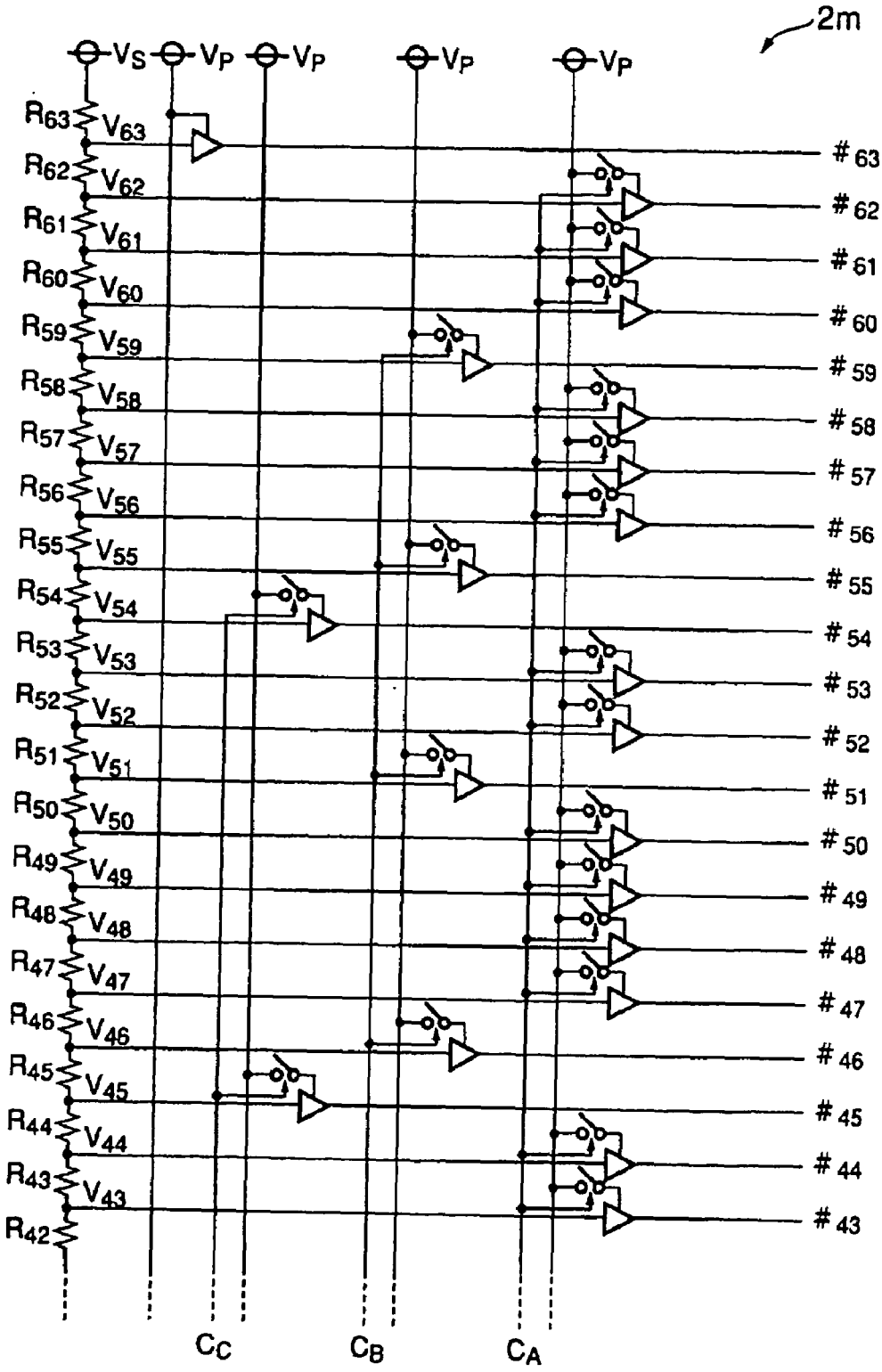
FIG. 22 is a block diagram showing a schematic construction of the upper part of one example of multi-stage switching type gray-scale voltage producing circuit according to the present invention.
Figure 23:
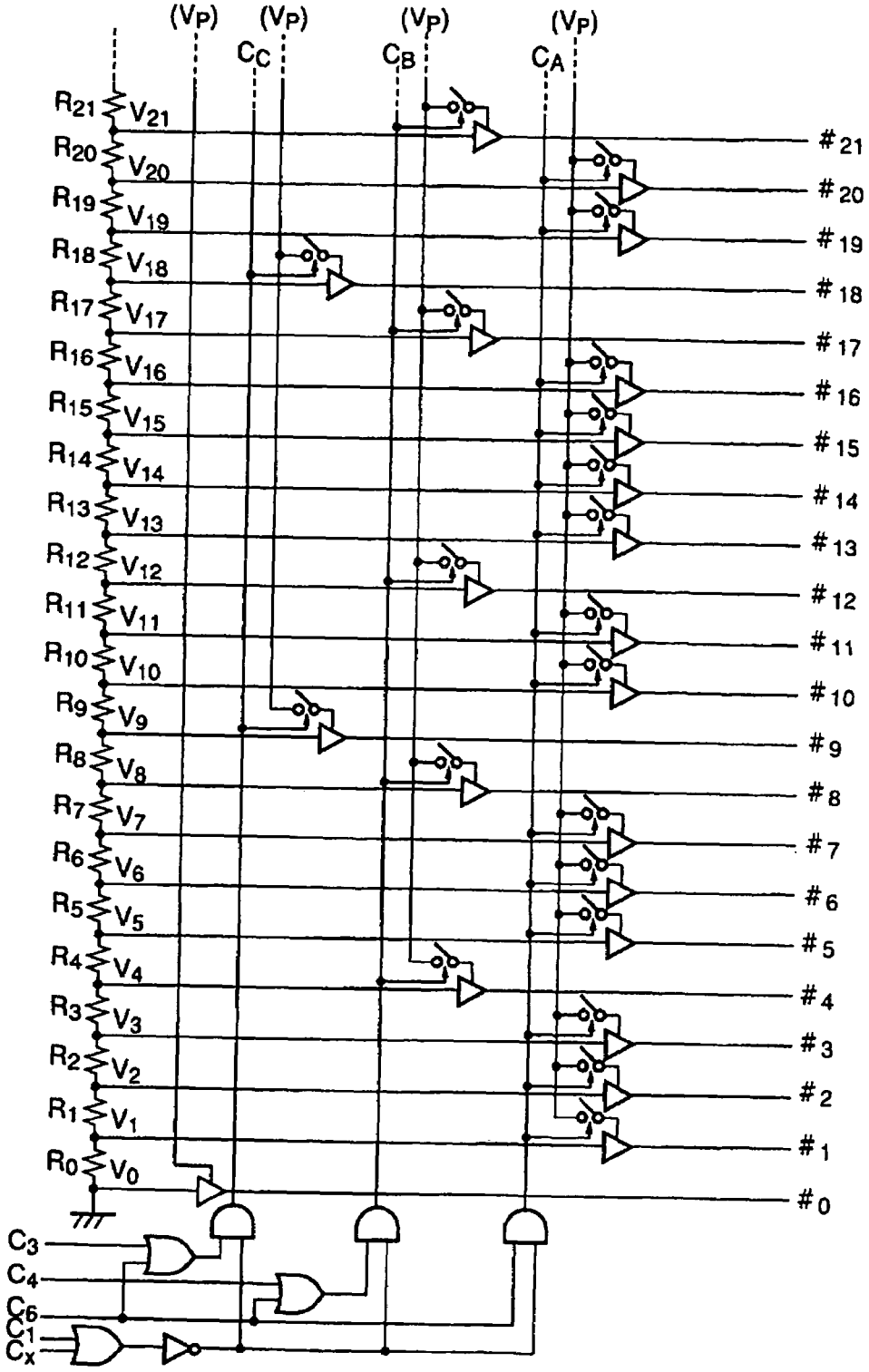
FIG. 23 is a block diagram showing a schematic construction of the lower part of one example of multi-stage switching type gray-scale voltage producing circuit according to the present invention.

FIGS. 22 and 23 shows a specific example of the gray-scale voltage producing circuit supporting multi-stepwise displaying.

This configuration supports the switching between different numbers of steps with 6-, 4-, 3- and 1-bit pixel data and a forced power-saving display mode. This configuration is also an expansion of the previously mentioned configuration in FIG. 4 and adopts the higher-order bit relocation format.

This gray-scale voltage producing circuit 2*m* uses control signals $C_6$, $C_4$, $C_3$ and $C_1$ which become active for the display manners of 6-, 4-, 3- and 1-bit pixel data, respectively and a control signal Cx which becomes active in the forced display mode. These control signals are prescribed as in the table shown in FIG. 24. This table expresses the followings: any one of the control signals $C_6$, $C_4$, $C_3$ and $C_1$ becomes active (high level) in correspondence with the number of gray-scale levels to be represented in a normal display mode (when the control signal Cx is non-active); and the control signal Cx becomes active (high level) in a forced display mode, indicating that the number of gray-scale levels to be represented should be set to 2 irrespective of states of the other control signals.

FIGS. 22 and 23 show the case where only amplifiers necessary for a display mode specified are operated according to those control signals. Verification of FIGS. 6, 19 and 21 is helpful to understand. By the way, pixel data are processed in order to obtain appropriate control signals for the selection circuits 30 to 3x in the forced mode, too. This is apparent from the above descriptions.

Thus, even if the gray-scale levels to be represented are divided into three or more stages, it is possible to realize appropriate (fine) power-saving according to each stage.

Figure 25:
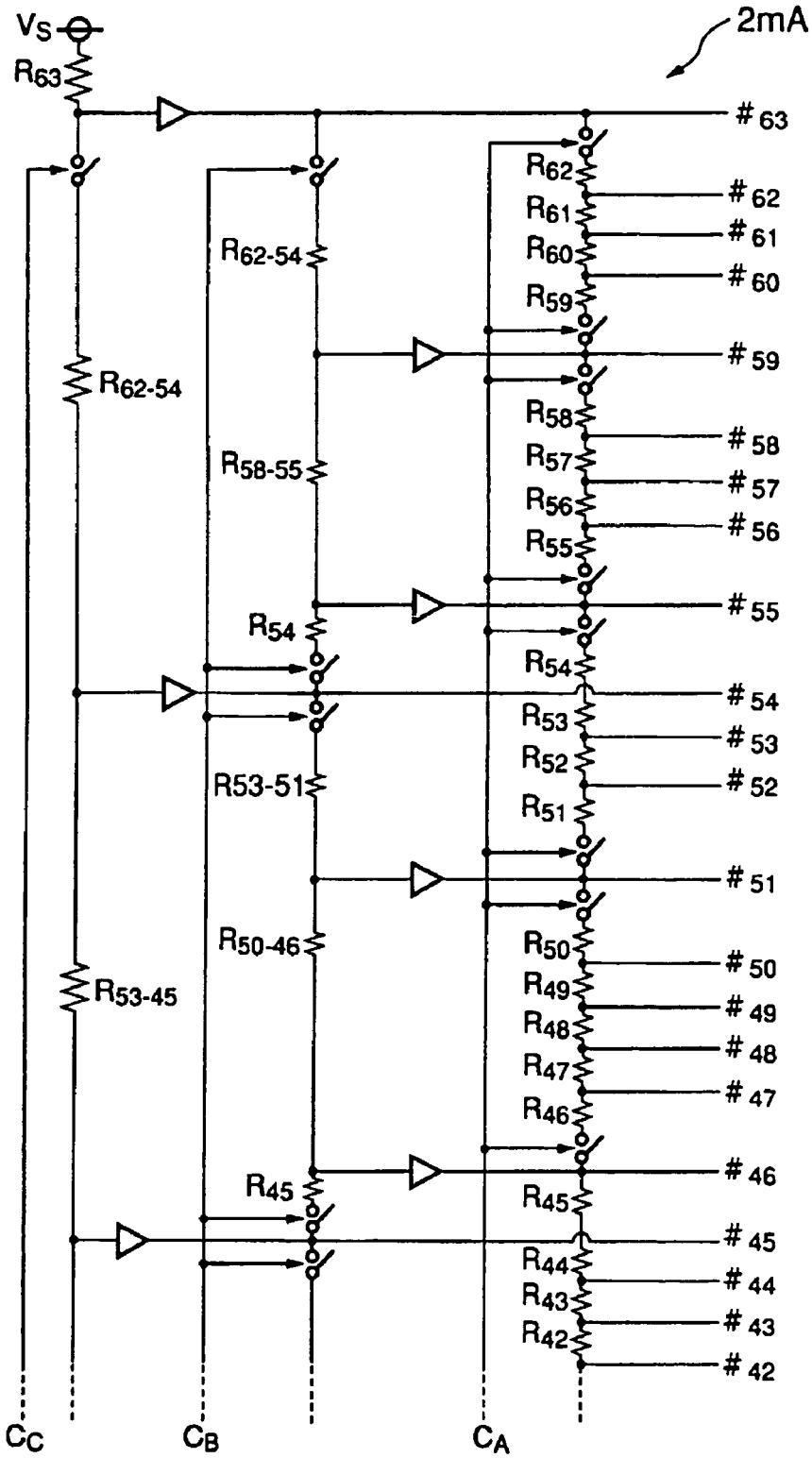
FIG. 25 is a block diagram showing a schematic construction of the upper part of another example of multi-stage switching type gray-scale voltage producing circuit according to the present invention.
Figure 26:
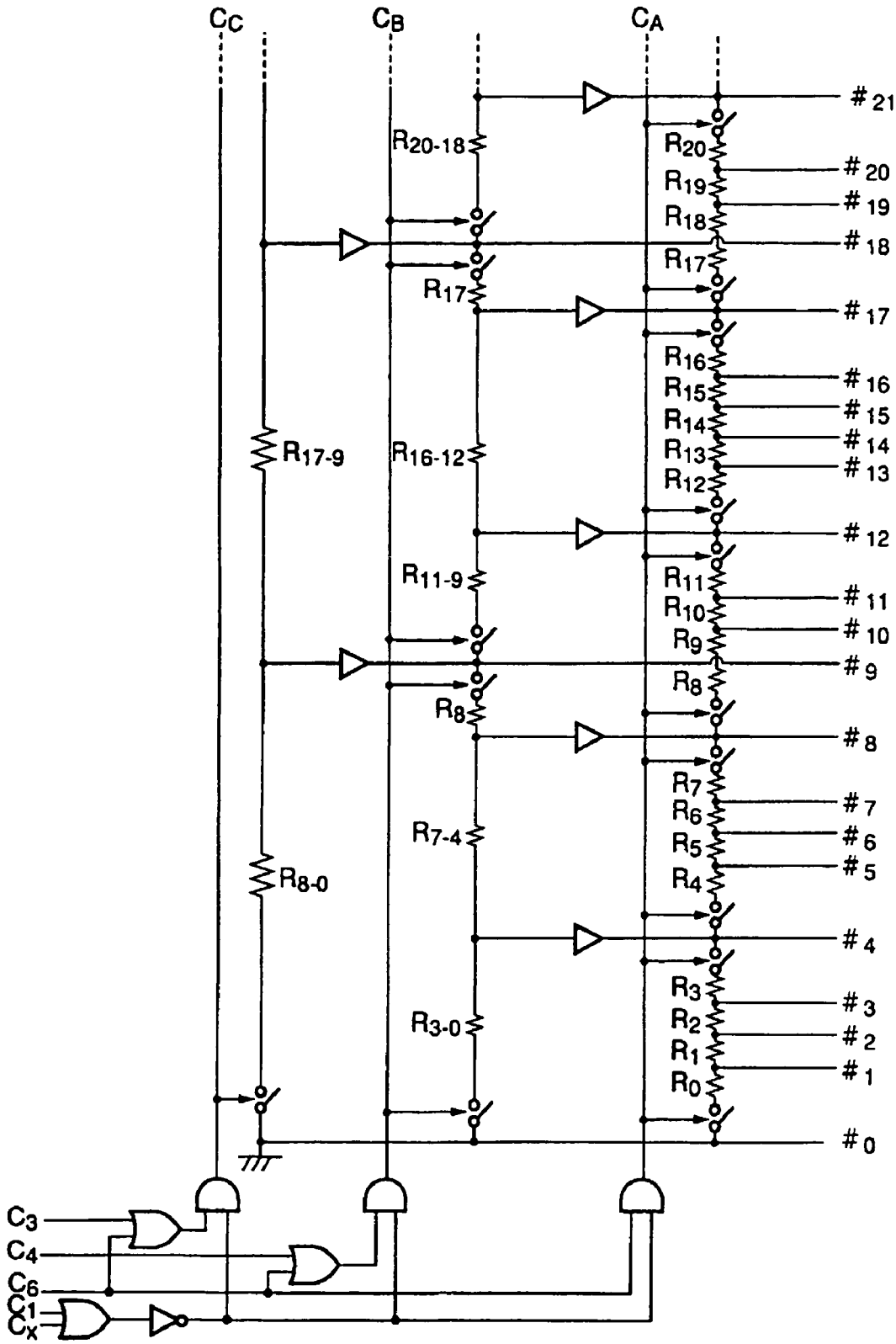
FIG. 26 is a block diagram showing a schematic construction of the lower part of another example of multi-stage switching type gray-scale voltage producing circuit according to the present invention.

The configuration in FIGS. 22 and 23 may be replaced by a configuration shown in FIGS. 25 and 26.

This configuration supports multi-stepwise switching of the number of gray-scale levels with 6-, 4-, 3- and 1-bit pixel data and a forced power-saving display mode. This configuration is an expansion of the configuration in FIG. 17 mentioned above, and adopts the higher-order bit relocation format.

This gray-scale voltage producing circuit 2mA also uses the similar control signals $C_6$, $C_4$, $C_3$, $C_1$ and Cx, and supplies outputs of amplifiers on the upstream side only to potential divider circuits necessary for the specified display mode. This example should also be understood together with FIGS. 6, 19, 21 and 24.

In the above embodiments, if pixel data with e.g. a full number of bits are inputted in the forced mode, the processing as shown in FIGS. 7, 10 and 14 (processing of decimating values indicated by the train of a greater number of bits) is performed to reduce the number of gray-scale levels to be selected while the gray-scale voltage producing circuit electrically isolates circuit elements for producing gray-scale voltages other than those to be selected. However, a forced mode for appropriate power-saving can be accomplished even without performing such decimation processing.

Figure 27:
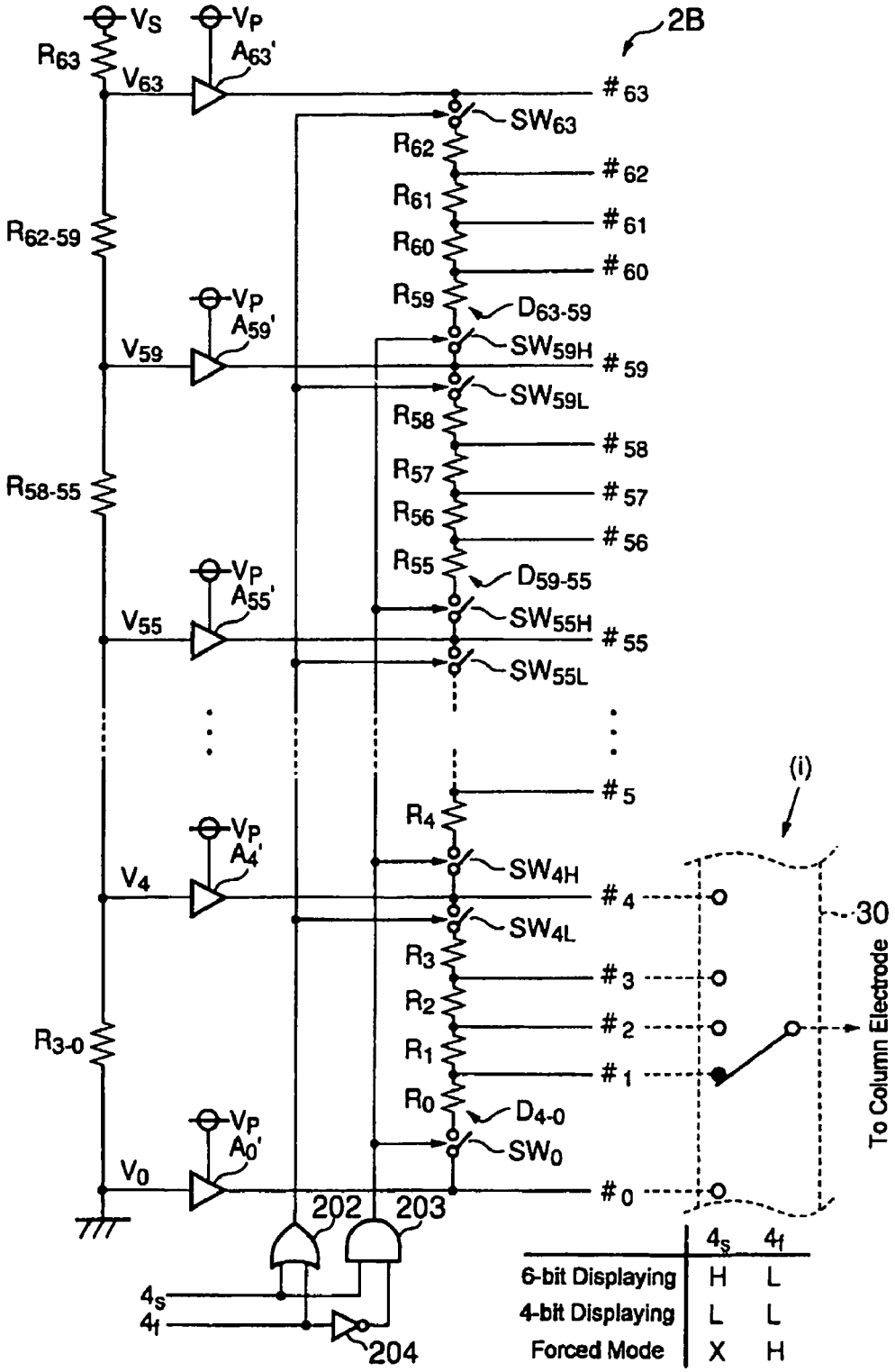
FIG. 27 is a block diagram showing a schematic construction of the other embodiment of gray-scale voltage producing circuit according to the present invention.

FIG. 27 shows a configuration to realize such a forced mode. This gray-scale voltage producing circuit 2B is worth that obtained by modifying the configuration in FIG. 17. According to this configuration, a control signal 4*s* for specifying a normal display mode is one input for an OR gate 202 and an AND gate 203, while a control signal 4*f* for specifying a forced display mode is the other input for the OR gate 202 and supplied to the other input of the AND gate 203 through an inverting gate 204. The output of the OR gate 202 is supplied to control inputs of upstream switching circuits $SW_{4L}, \ldots, SW_{55L}, SW_{59L}, SW_{63}$ to which a higher potential of the respective fine potential divider circuits is applied. The output of the AND gate 203 is supplied to control inputs of downstream switching circuits $SW_0$, $SW_{4H}, \ldots, SW_{55H}, SW_{59H}$ to which a lower potential of the respective fine potential divider circuits is applied.

In such a configuration, the output of the gate 202 becomes active (high level) when the control signal 4*f* becomes active (high level) and the upstream switching circuits turn ON, while the output of the gate 203 becomes non-active (low level) and the downstream switching circuits turn OFF. In this condition, each of the potential divider circuit no longer functions as the original potential divider circuit, and even if the upstream side switching circuits close a possible conducting path between the amplifier outputs, the downstream side switching circuits open the path, which prevents a current (due to the effect of potential division) from flowing through the fine potential divider circuits between the outputs of the amplifiers. And at this time, all the potential divisional output ends of the respective fine potential divider circuits will represent a voltage almost equal to the supply voltage on the upstream side. This is generally attributable to the fact that the divisional potential output ends are coupled with the column electrodes of the display device through the selection circuits 30 to 3x, while the capacitance component constitutes the main part of the load on the signal route including the column electrodes and the dividing resistor component of the fine potential divider circuits is negligible.

For example, consider a case where a bit train of the input pixel data is "000001" in a forced mode. In this case, the corresponding selection circuit selects the voltage #1, but the downstream switch $SW_0$ is opened and the upstream switch $SW_{4L}$ is closed in the potential divider circuit $D_{4-0}$ corresponding to the value of the bit train, and therefore the output of #1 is output which has been passed through the resistors $R_3$, $R_2$ and $R_1$ from the output of the amplifier $A_4'$. In contrast to this, the corresponding selection circuit performs a selection of the data "000001" without the decimation, and therefore selects the output of #1 as usual. However, this output #1 is coupled with a column electrode which extends much long in the display area through the selection circuit, so that a load of the conditions as described above is caused, whereby the resistors $R_3$, $R_2$ and $R_1$ do not substantially form a potential divider circuit, and the voltage of #1 will be a voltage having nearly the same value as that of the output voltage of the amplifier $A_4'$. The partial drawing pointed by an arrow (i) in FIG. 27 shows this appearance. Likewise, a voltage having nearly the same value as that of the outputted voltage of the amplifier $A_4'$ is outputted when the voltage of #2 or #3 is selected.

Thus, the selection circuit outputs the specific gray-scale voltage of #4 not only for data "000010" (corresponding to #4), but also for "000001" (corresponding to #1), "000010" (corresponding to #2) and "000011" (corresponding to #3). For other fine potential divider circuits, the specific gray-scale voltage on the upstream side is likewise outputted as an output divisional voltage. Hence, an appropriate forced display mode is attained without depending on the aforementioned decimation processing.

By the way, the same switching control may also be performed and the decimation processing may be omitted not only in the forced mode, but also in a normal 4-bit display mode. Such a modification example is shown in FIGS. 28 and 29.

Figure 28:
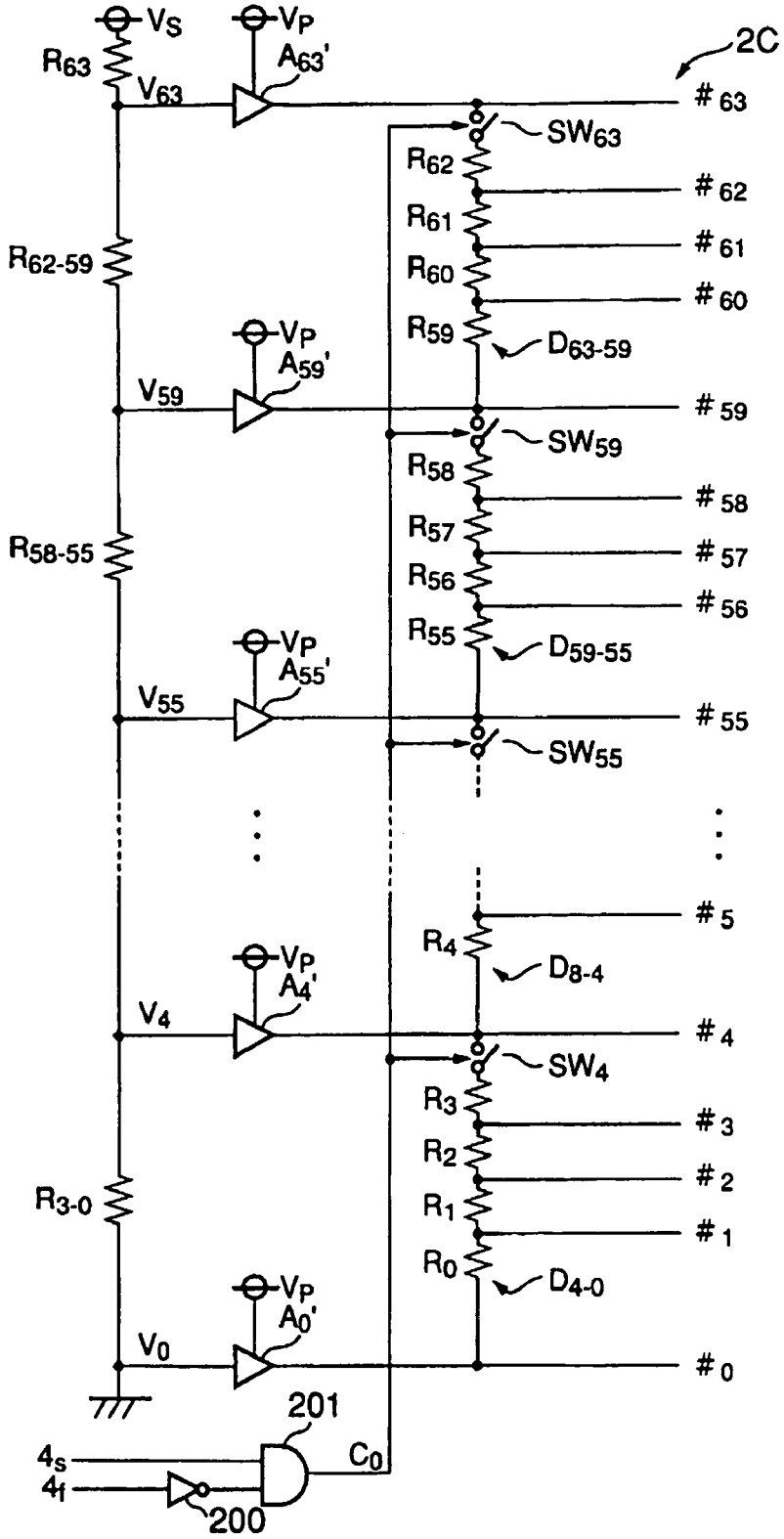
FIG. 28 is a block diagram showing a schematic construction of a further embodiment of gray-scale voltage producing circuit according to the present invention.
Figure 29:
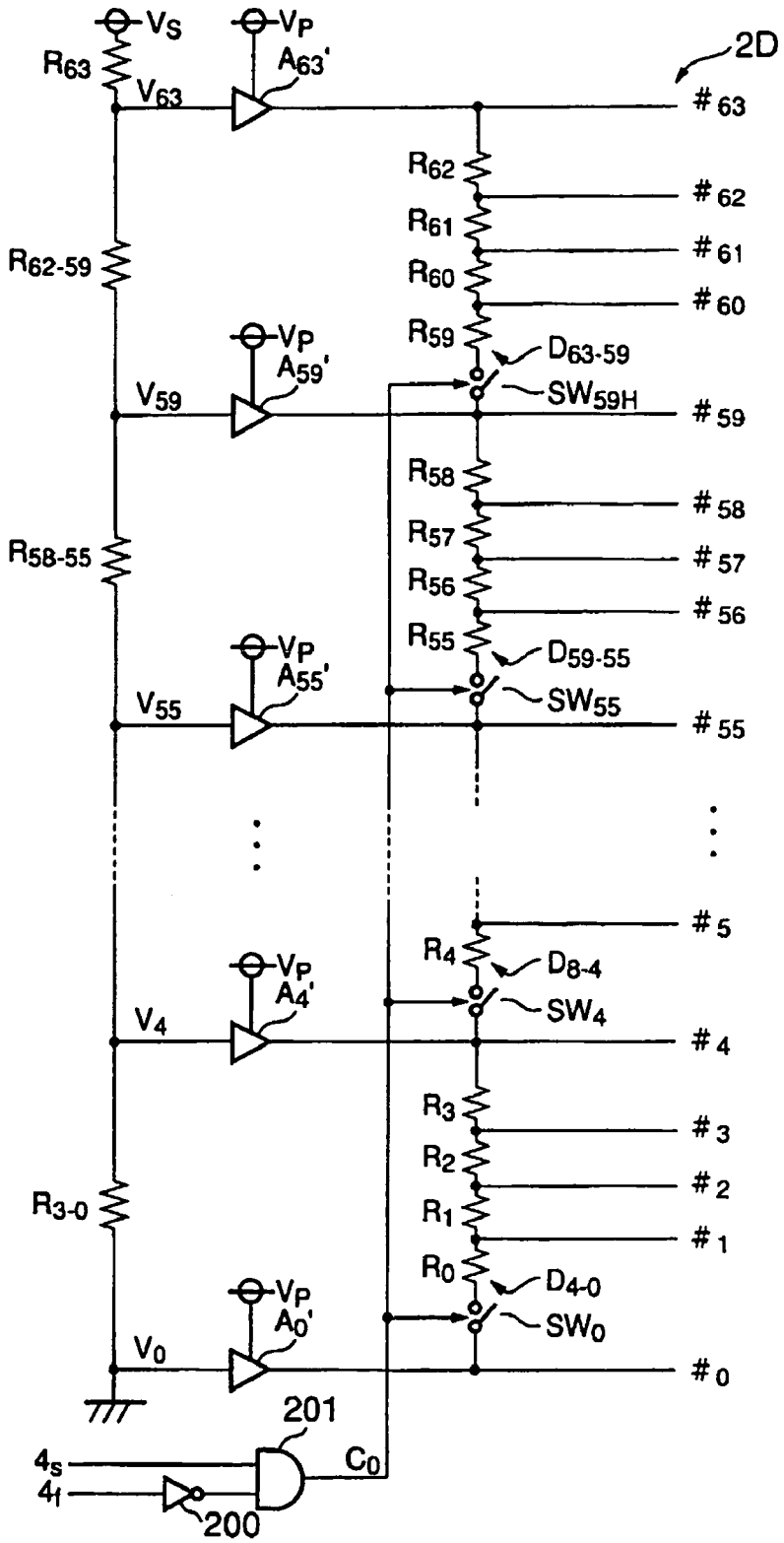
FIG. 29 is a block diagram showing a schematic construction of a yet further embodiment of gray-scale voltage producing circuit according to the present invention.

FIG. 28 shows a first example of a gray-scale voltage producing circuit 2C provided with only upstream side switching circuits and FIG. 29 shows a second example of a gray-scale voltage producing circuit 2D provided with only downstream side switching circuits. According to the first example, the upstream side switching circuits are opened in both the forced mode and the normal 4-bit display mode, and a low potential given to the potential divider circuit appears at their respective potential divider output ends at almost the same level. According to the other example, the downstream side switching circuits are opened in both the forced mode and the normal 4-bit display mode, and a high potential given to the potential divider circuit appears at their respective potential divider output ends at almost the same level. Moreover, neither of the two examples requires the decimation processing.

It goes without saying that the feature of setting the potential divider output ends to either the upstream side or downstream side specific gray-scale voltage is also applicable to the configuration in FIG. 18 and those in FIGS. 25 and 26, and more.

Furthermore, the foregoing embodiments have been described only to the effect that gray-scale voltages are ranked in equal intervals, but the present invention is not limited to this. The extent of "substantially equal intervals" should be interpreted in a wider sense.

Furthermore, the foregoing embodiments have taken as examples cases where pixel signals are updated and outputted to the column electrodes for each row, that is, in line-sequence, but the present invention is not limited to the examples and they may be modified to a configuration in which the pixel signals are updated and outputted for each pixel or each predetermined displayed unit, that is, in dot-sequence. For example, in a part of source driver or an ancillary circuit coupled therewith in the display panel on which LTPS (low-temperature polysilicon)-based TFTs are formed, it goes without saying that in synchronization with or in response to serial input having a form in which a sequence of pixel information pieces as shown in "Input of S/P1" of FIG. 3 is supplied, serial output may be done in the same form of a sequence of pixel information pieces so as to drive the column electrodes in column-sequence. In this case, the data conversion circuit 1 may be unnecessary.

As an additional remark, the configuration of the gray-scale voltage producing circuit has been described as having two types; one based on operation/non-operation of amplifiers and the other based on output-enabling/disabling of potential divider circuits, but these two types can also be combined as appropriate.

As a further remark, the foregoing explanations have made for the case where an amplifier intervenes in the line of gray-scale voltage #0, but this amplifier may be omitted. Therefore, note that the present invention does not exclude such a case.

In addition, those skilled in the art can create any modifications for the present invention without departing from the scope of the protection described in the claims thereof.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A column electrode driving circuit for a display device having a matrix of rows and columns of display segments, a display segment comprising at least one pixel capable of gray-scale displaying, the driving circuit comprising:

gray-scale voltage producing means including amplifiers, each amplifier having a first input for receiving one value of a range of a plurality of gradually increasing gray-scale voltage values, and having an amplifier output for delivering an output signal in proportion to the voltage level at the input; and selecting means having inputs coupled to the outputs of the amplifiers for selecting and outputting any of the output signals of the amplifiers for each display segment in a row that is being addressed in accordance with an image signal indicative of a gray-scale level to be generated by the display segment, the gray-scale voltage producing means having a predetermined mode wherein a predetermined number of amplifiers, which correspond to a predetermined number of predetermined gray-scale values within the range, are always powered on and other amplifiers are selectively powered on or off, and the selecting means select output signals of the amplifiers which are powered on, the amplifiers which are always powered on being arranged to receive non-sequential gray-scale voltage values ranging from a minimum gray-scale voltage value to a maximum gray-scale voltage value and the other amplifiers being arranged to receive gray-scale voltage values between the minimum and maximum gray-scale voltage values received by the always-on amplifiers such that the full range of gray-scale voltage values is used both when the other amplifiers are powered off and when the other amplifiers are powered on.

2. A column electrode driving circuit as defined in claim 1, wherein the predetermined mode includes a plurality of sub-modes, and the amplifiers to be powered on are determined for each sub-mode by the gray-scale voltage producing means.

3. A column electrode driving circuit as defined in claim 1, further comprising means for receiving a control signal for designating a content of the predetermined mode, the gray-scale voltage producing means performing power control on a power supply of the amplifiers in accordance with the control signal.

4. A column electrode driving circuit as defined in claim 1, wherein specific gray-scale voltage values applied to amplifiers to be powered on are assigned gray-scale voltage values within the range of voltage values between the minimum gray-scale voltage value and the maximum gray-scale voltage value, which have been selected in accordance with the predetermined mode.

5. A column electrode driving circuit as defined in claim 4, wherein the specific gray-scale voltage values include the maximum gray-scale voltage value and/or the minimum gray-scale voltage value.

6. A driving circuit as defined in claim 4, wherein the specific gray-scale voltage values are assigned gray-scale voltage values which are a subset of the range of voltage values having substantially an equal difference between two subsequent values of the subset.

7. A driving circuit as defined in claim 1, further comprising data processing means for converting an input bit train comprising a sequence of groups of bits, each group of bits determining a gray level of an image point of the image, for each display segment a corresponding image point being present, of an input image signal into a new bit train having only groups of bits corresponding to the predetermined gray-scale values designated by the predetermined mode;

the selecting means performing selection based on the image signal, being the new bit train.

8. A driving circuit as defined in claim 7, wherein the data processing means form the new bit train using a content of at least one higher-order bit of the input bit train for its lower-order bit.

9. A driving circuit as defined in claim 7, wherein the data processing means form the new bit train using a fixed value of at least one bit for its lower-order bit.

10. A driving circuit as defined in claim 8, wherein the data processing means form the new bit train such that the bit train can have a value capable of designating a maximum gray-scale voltage and/or a minimum gray-scale voltage.

11. A column electrode driving circuit for a display device capable of gray-scale displaying, comprising:

gray-scale voltage producing means including amplifiers which relay a plurality of gray-scale voltages having values that are gradually level-shifted, respectively, and potential divider circuits each coupled to outputs of a pair of the amplifiers for dividing two output voltages of the pair of amplifiers to produce gray-scale voltages between the output voltages of the pair of amplifiers; and selecting means for selecting and outputting any of the gray-scale voltages for each pixel or each predetermined displayed unit in accordance with an image signal indicative of a gray-scale level for the pixel or displayed unit, the gray-scale voltage producing means selectively output-disabling any potential divider circuits that produce a predetermined number of gray-scale voltages which correspond to predetermined gray-scale levels, in a predetermined mode, by electrically isolating the subject potential divider circuit from the corresponding amplifier or amplifiers or by avoiding an output current of that amplifier or amplifiers from flowing possibly caused by its dividing action to make the flowing to be substantially impossible, the selecting means selecting any of effective voltages during the predetermined mode, wherein at least one of the potential divider circuits includes a plurality of resistors and the predetermined mode includes a plurality of sub-modes, and the potential divider circuits to be output-enabled are determined for each sub-mode in the pray-scale voltage producing means.

12. A column electrode driving circuit as defined in claim 11, wherein the driving circuit comprises means for receiving a control signal for designating a content of the predetermined mode, and the gray-scale voltage producing means perform output-disablement/enablement control on the potential divider circuits in accordance with the control signal.

13. A driving circuit as defined in claim 11, wherein the divider circuits each have a first connection end given a higher potential and a second connection end given a lower potential for dividing a potential difference between the first and second connection ends, the connection ends being coupled to output lines of the pair of amplifiers, at least one of the connection ends being coupled to the output line of one of the amplifiers via a switching circuit that causes a conducting path between the output lines to be opened or closed, the switching circuit performing open-control on the path at the time when output of the divider circuit is disabled.

14. A driving circuit as defined in claim 11, wherein the divider circuits have a first connection end given a higher potential and a second connection end given a lower potential for dividing a potential difference between the first and second connection ends, the connection ends being coupled between output lines of the pair of amplifiers, only one of the connection ends being coupled to the output line via a switching circuit that causes a conducting path between the output lines to be opened or closed, the switching circuit performing open-control on the path at the time when output of the divider circuit is disabled.

15. A driving circuit as defined in claim 1, wherein the predetermined mode has at least one mode to represent a less number of gray-scale levels than the maximum number of gray-scale levels.

16. A driving circuit as defined in claim 15, wherein the predetermined mode includes a mode to represent a necessary number of gray-scale levels for display operation and a mode to represent gray-scale levels forcedly designated.

17. A driving circuit as defined in claim 1, wherein outputs of the gray-scale voltage producing means are applied to the selecting means not via other amplifiers, and the selecting means make their selection outputs not via other amplifiers.

18. A display device comprising a display panel; and a column electrode driving circuit as defined in claim 1.

19. A display device according to claim 18, wherein contents of the predetermined mode are defined in accordance with waiting states.

* * * * *